US006747616B2

(12) United States Patent
Honda et al.

(10) Patent No.: US 6,747,616 B2
(45) Date of Patent: Jun. 8, 2004

(54) DISPLAY PANEL DRIVING METHOD

(75) Inventors: Hirofumi Honda, Yamanashi (JP); Tetsuya Shigeta, Yamanashi (JP); Tetsuro Nagakubo, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 351 days.

(21) Appl. No.: 09/836,224

(22) Filed: Apr. 18, 2001

(65) Prior Publication Data

US 2002/0005842 A1 Jan. 17, 2002

(30) Foreign Application Priority Data

Apr. 18, 2000 (JP) ..... 2000-116971

(51) Int. Cl.[7] ..... G09G 3/28
(52) U.S. Cl. ..... 345/63; 345/60; 345/691
(58) Field of Search ..... 345/60–70, 208–210, 345/691, 690, 692, 204; 315/169.3, 169.4

(56) References Cited

U.S. PATENT DOCUMENTS 5,757,343 A * 5/1998 Nagakubo ..... 345/63
6,037,917 A * 3/2000 Kawakami ..... 345/63
6,323,596 B1 * 11/2001 Ito et al. ..... 315/169.3
6,323,880 B1 * 11/2001 Yamada ..... 345/690
6,369,782 B2 * 4/2002 Shigeta ..... 345/63
6,407,506 B1 * 6/2002 Naka et al. ..... 315/169.1
6,448,960 B1 * 9/2002 Shigeta ..... 345/204
6,552,736 B2 * 4/2003 Honda et al. ..... 345/691

* cited by examiner

*Primary Examiner*—Lun-Yi Lao
(74) *Attorney, Agent, or Firm*—Sughrue Mion, PLLC

(57) ABSTRACT

A display panel driving method capable of performing a good intermediate luminance display corresponding to an input video signal. A unit display period in a video signal is composed of a plurality of divisional display periods. In each of the divisional display periods, a pixel data writing process is performed for setting each of pixel cells to either a light emitting cell or a non-light emitting cell in accordance with pixel data corresponding to the video signal, and a light emission sustain process is performed for causing only the light emitting cells to emit light a number of light emissions allocated in correspondence to a weighting factor applied to each of the divisional display period. A luminance distribution of the video signal is measured every display line on the display panel, and the number of light emissions allocated to each of the light emission sustain process is changed every display line in accordance with the luminance distribution.

15 Claims, 21 Drawing Sheets

FIG. 23

[SELECTIVE ERASURE]

| GRADATION LEVEL | CONVERSION TABLE FOR SECOND DATA CONVERTER CIRCUIT 34 | | | | | | LIGHT EMISSION DRIVING PATTERN | | | | | DISPLAY LUMINANCE | | | |
|---|---|---|---|---|---|---|---|---|---|---|---|---|---|---|---|
| | Ds | GD 1 | 2 | 3 | 4 | 5 | SF 1 | SF 2 | SF 3 | SF 4 | SF 5 | (a) | (b) | (c) | (d) |
| 1 | 000 | 1 | 0 | 0 | 0 | 0 | ● | | | | | 0 | 0 | 0 | 0 |
| 2 | 001 | 0 | 1 | 0 | 0 | 0 | ○ | ● | | | | 7 | 2 | 44 | 83 |
| 3 | 010 | 0 | 0 | 1 | 0 | 0 | ○ | ○ | ● | | | 34 | 7 | 69 | 117 |
| 4 | 011 | 0 | 0 | 0 | 1 | 0 | ○ | ○ | ○ | ● | | 83 | 18 | 99 | 157 |
| 5 | 100 | 0 | 0 | 0 | 0 | 1 | ○ | ○ | ○ | ○ | ● | 157 | 34 | 136 | 203 |
| 6 | 101 | 0 | 0 | 0 | 0 | 0 | ○ | ○ | ○ | ○ | ○ | 255 | 255 | 255 | 255 |

BLACK CIRCLE : SELECTIVE ERASURE DISCHARGE
WHITE CIRCLE : LIGHT EMISSION

FIG. 30

[SELECTIVE ERASURE]

| GRADATION LEVEL | CONVERSION TABLE FOR SECOND DATA CONVERTER CIRCUIT 34 | | | | | | LIGHT EMISSION DRIVING PATTERN | | | | | DISPLAY LUMINANCE | | | |
|---|---|---|---|---|---|---|---|---|---|---|---|---|---|---|---|
| | Ds | GD 1 | 2 | 3 | 4 | 5 | SF 1 | SF 2 | SF 3 | SF 4 | SF 5 | (a) | (b) | (c) | (d) |
| 1 | 000 | 1 | 1 | 0 | 0 | 0 | ● | ● | | | | 0 | 0 | 0 | 0 |
| 2 | 001 | 0 | 1 | 1 | 0 | 0 | ○ | ● | ● | | | 7 | 2 | 44 | 83 |
| 3 | 010 | 0 | 0 | 1 | 1 | 0 | ○ | ○ | ● | ● | | 34 | 7 | 69 | 117 |
| 4 | 011 | 0 | 0 | 0 | 1 | 1 | ○ | ○ | ○ | ● | ● | 83 | 18 | 99 | 157 |
| 5 | 100 | 0 | 0 | 0 | 0 | 1 | ○ | ○ | ○ | ○ | ● | 157 | 34 | 136 | 203 |
| 6 | 101 | 0 | 0 | 0 | 0 | 0 | ○ | ○ | ○ | ○ | ○ | 255 | 255 | 255 | 255 |

BLACK CIRCLE : SELECTIVE ERASURE DISCHARGE
WHITE CIRCLE : LIGHT EMISSION

FIG. 32

[SELECTIVE WRITE]

| GRADATION LEVEL | CONVERSION TABLE FOR SECOND DATA CONVERTER CIRCUIT 34 | | | | | | LIGHT EMISSION DRIVING PATTERN | | | | | DISPLAY LUMINANCE | | | |
|---|---|---|---|---|---|---|---|---|---|---|---|---|---|---|---|
| | $D_S$ | GD 5 | 4 | 3 | 2 | 1 | SF 5 | SF 4 | SF 3 | SF 2 | SF 1 | (a) | (b) | (c) | (d) |
| 1 | 000 | 0 | 0 | 0 | 0 | 0 | | | | | | 0 | 0 | 0 | 0 |
| 2 | 001 | 0 | 0 | 0 | 0 | 1 | | | | | ● | 7 | 2 | 44 | 83 |
| 3 | 010 | 0 | 0 | 0 | 1 | 0 | | | | ● | ○ | 34 | 7 | 69 | 117 |
| 4 | 011 | 0 | 0 | 1 | 0 | 0 | | | ● | ○ | ○ | 83 | 18 | 99 | 157 |
| 5 | 100 | 0 | 1 | 0 | 0 | 0 | | ● | ○ | ○ | ○ | 157 | 34 | 136 | 203 |
| 6 | 101 | 1 | 0 | 0 | 0 | 0 | ● | ○ | ○ | ○ | ○ | 255 | 255 | 255 | 255 |

BLACK CIRCLE : SELECTIVE WRITING DISCHARGE + LIGHT EMISSION
WHITE CIRCLE : LIGHT EMISSION

DISPLAY PANEL DRIVING METHOD

BACKGROUND OF THE INVENTION

1. Field of the Invention

The present invention relates to a method for driving a plasma display panel in a matrix display scheme.

2. Description of Related Art

In recent years, a plasma display panel (hereinafter referred to as the "PDP"), an electroluminescent display panel (hereinafter referred to as the "ELDP") and so on have been brought into practical use as thin flat display panels of matrix display scheme. The PDP and ELDP have pixel cells, which function as pixels respectively, arranged in the form of a matrix comprised of n rows and m columns. The pixel cells have only two states: "light emission" and "non-light emission." Therefore, gradation driving based on a subfield method is carried out for a display panel such as the above-mentioned PDP and ELDP to provide a halftone luminance level corresponding to an input video signal.

The subfield method involves converting an input video signal into N-bit pixel data pixel by pixel, and composing one field display period with N subfields each of which corresponds to each of N bit digits. A number of light emissions corresponding to each of the bit digits in the pixel data, is allocated to each of the subfields, respectively. When a bit digit in the N bits is, for example, at logical level "1," light is emitted the number of times allocated as mentioned above in a subfield corresponding to the bit digit. On the other hand, when the bit digit is at logical level "0," no light is emitted in the subfield corresponding to the bit digit. The driving sequence using the subfield method represents a halftone luminance level corresponding to an input video signal by a total number of light emission which is performed in each of the subfields within one field display period.

OBJECT AND SUMMARY OF THE INVENTION

It is an object of the present invention to provide a display panel driving method which is capable of accomplishing a good intermediate luminance display corresponding to an input video signal for a display panel comprised of a matrix of pixel cells, each of which has only two states of light emission and non-light emission.

The present invention provides a display panel driving method for driving a display panel having a plurality of pixel cells arranged in matrix in accordance with a video signal. In each of a plurality of divisional display periods of a unit display period in the video signal, a pixel data writing process is performed for setting each of the pixel cells to either a light emitting cell or a non-light emitting cell in accordance with pixel data corresponding to the video signal to write the pixel data, and a light emission sustain process is performed for causing only the light emission cells to emit light a number of light emissions allocated thereto corresponding to a weighting factor applied to each of the divisional display periods. A luminance distribution of the video signal is measured every display line on the display panel, and the number of light emissions allocated to the divisional display period every display line is changed in accordance with the luminance distribution.

BRIEF DESCRIPTION OF THE DRAWINGS

FIG. 23 is a diagram showing a conversion table for a second data converter circuit 34 and light emission driving patterns based on drive pixel data GD;

FIG. 30 is a diagram showing another example of a conversion table for the second data converter circuit 34, and light emission driving patterns based on drive pixel data GD;

FIG. 32 is a diagram showing another example of a conversion table for the second data converter circuit 34, and light emission driving patterns based on drive pixel data GD, used when the selective write address method is employed.

DETAILED DESCRIPTION OF THE EMBODIMENTS

In the following, embodiments of the present invention will be described with reference to the accompanying drawings.

Figure 1:
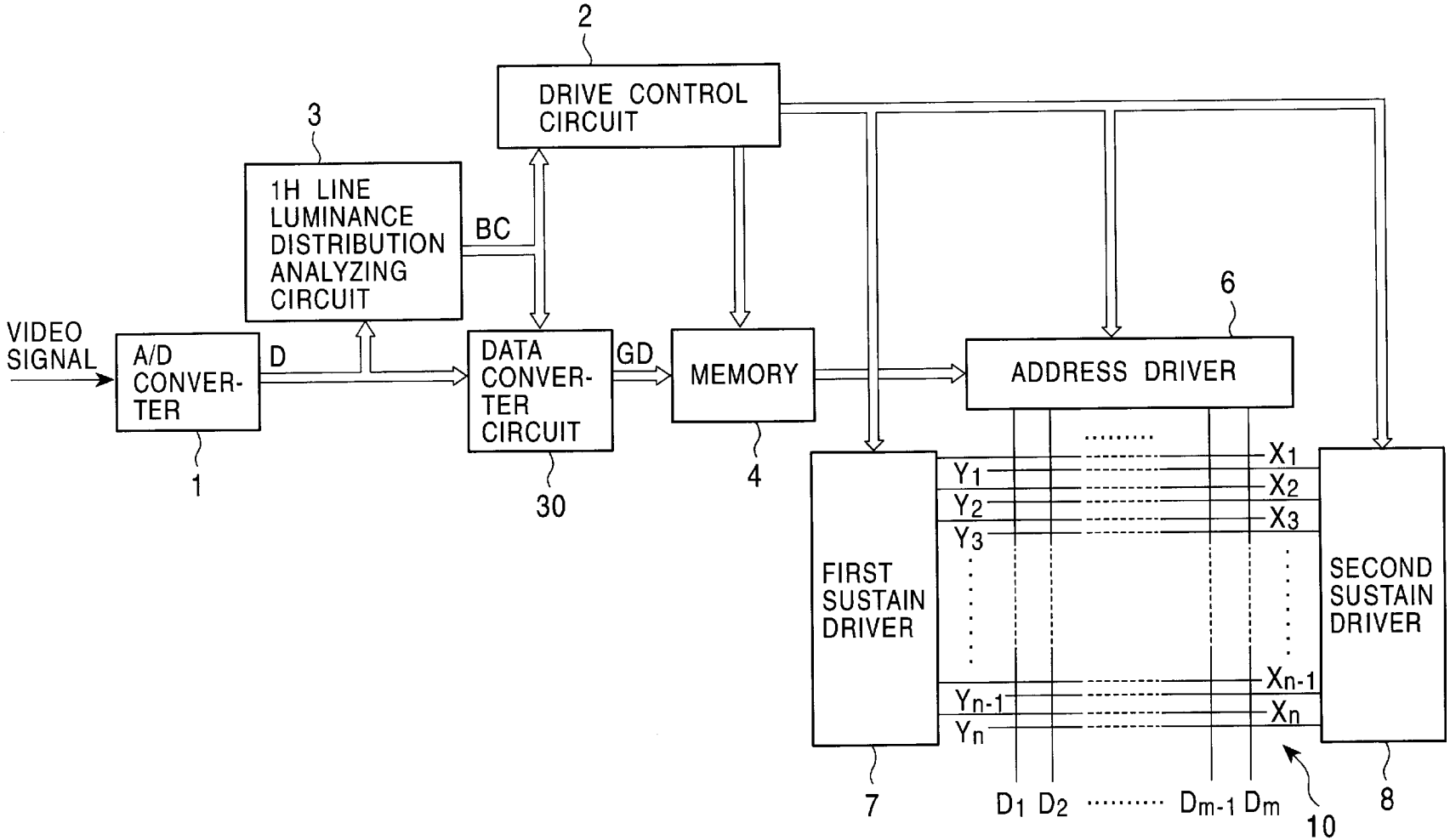
FIG. 1 is a block diagram illustrating the configuration of a plasma display device which drives a plasma display panel in accordance with a driving method according to the present invention.

FIG. 1 is a block diagram generally illustrating the configuration of a plasma display device which is equipped with a plasma display panel as a display panel comprised of pixel cells, arranged in matrix, each of which has only two states, i.e., light emission and non-light emission.

As illustrated in FIG. 1, the plasma display device comprises a PDP 10 as a plasma display panel and a driving unit for driving the plasma display panel based on a driving method according to the present invention.

The PDP 10 comprises m column electrodes $D_1$–$D_m$ as address electrodes, and n row electrodes $X_1$–$X_n$ and n row electrodes $Y_1$–$Y_n$ which are arranged to intersect these column electrodes. In the PDP 10, a pair of a row electrode X and a row electrode Y form a row electrode for displaying one display line on the PDP 10. The column electrode D and the row electrode pairs X, Y are covered with a dielectric layer defining a discharge space. A discharge cell corresponding to one pixel is formed at an intersection of each row electrode pair with each column electrode as a pixel cell. In other words, m pixels are formed corresponding to the m column electrodes D, respectively, on one display line.

An A/D converter 1 in the driving unit samples the input video signal for conversion to, for example, an 8-bit pixel data D for each pixel. Then, the A/D converter 1 supplies the pixel data D to each of a 1H line luminance distribution analyzing circuit 3 and a data converter circuit 30.

The 1H line luminance distribution analyzing circuit 3, each time it is supplied with m pixel data D for one display line from the A/D converter 1, analyzes a luminance distribution on the display line based on the m pixel data D. Then, the 1H line luminance distribution analyzing circuit 3 determines which of predefined luminance distribution classifications the result of the analysis falls under, and supplies each of the drive control circuit 2 and the data converter circuit 30 with a luminance distribution classification signal BC indicative of the determined luminance distribution classification.

Figure 2:
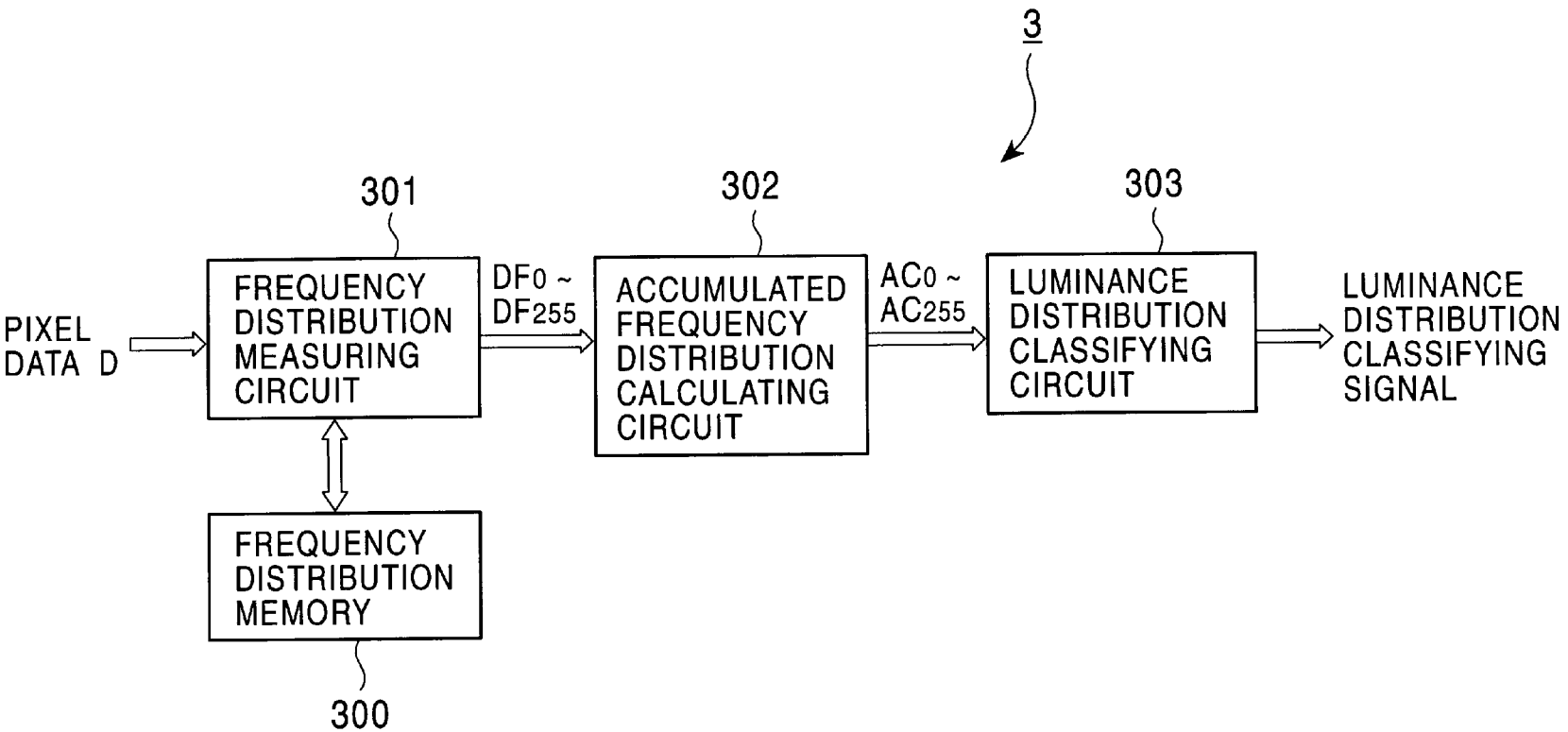
FIG. 2 is a block diagram illustrating the internal configuration of a 1H line luminance distribution analyzing circuit 3.

FIG. 2 is a block diagram illustrating an exemplary internal configuration of the 1H line luminance distribution analyzing circuit 3.

Figure 3:
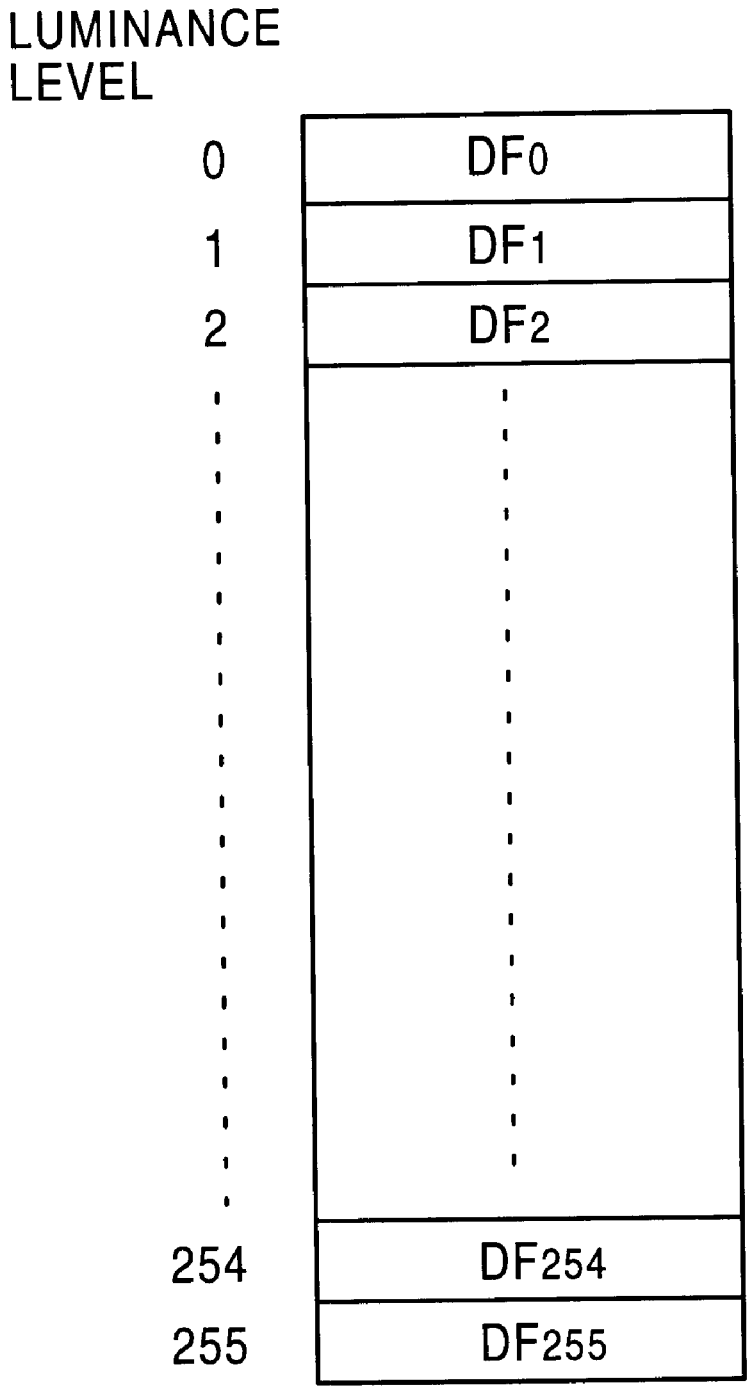
FIG. 3 is a diagram showing a memory map for a luminance distribution memory 300.

In FIG. 2, a frequency distribution memory 300 comprises 256 storage locations respectively corresponding to all possible luminance levels "0" to "255" represented by the pixel data D, as shown in FIG. 3. Each of the storage locations stores frequency data $DF_0$–$DF_{255}$ indicative of the number of times the pixel data D having an associated luminance level has been supplied. Each of the frequency data $DF_0$–$DF_{255}$ has an initial value "0."

A frequency distribution measuring circuit 301, each time it is supplied with pixel data D for one pixel from the A/D converter 1, increments only the frequency data DF corresponding to a luminance level of the supplied pixel data D by one. Then, the frequency distribution measuring circuit 301 reads the frequency data $DF_0$–$DF_{255}$ from the frequency distribution memory 300 and supplies them to an accumulated frequency distribution calculating circuit 302 each time the foregoing processing has been completed for m pixel data D of one display line.

The accumulated frequency distribution calculating circuit 302 sequentially accumulates the frequency data $DF_0$–$DF_{255}$ corresponding to one display line, starting with that corresponding to the lowest luminance level, and finds intermediate results at respective accumulating processs as accumulated frequency data $AC_0$–$AC_{255}$ corresponding to the luminance levels "0" to "255," respectively. Specifically, the accumulated frequency distribution calculating circuit 302 finds the accumulated frequency data $AC_0$–$AC_{255}$ respectively corresponding to the luminance levels "0" to "255" by the following calculations.

| | |
|---|---|
| Luminance Level "0": | $AC_0 = DF_0$ |
| Luminance Level "1": | $AC_1 = DF_0 + DF_1$ |
| Luminance Level "2": | $AC_2 = DF_0 + DF_1 + DF_2$ |
| . | |
| . | |
| . | |
| Luminance Level "255": | $AC_{255} = DF_0 + DF_1 + DF_2 + DF_3 + \ldots DF_{255}$ |

In this event, since one display line is comprised of m pixel data, a maximum value for the accumulated frequency data AC is "m." Then, the accumulated frequency distribution calculating circuit 302 supplies a luminance distribution classifying circuit 303 with the accumulated frequency data $AC_0$–$AC_{255}$.

First, the luminance distribution classifying circuit 303 sequentially retrieves the accumulated frequency data $AC_0$–$AC_{255}$ from those corresponding to lower luminance levels. In the meantime, a luminance level corresponding to accumulated frequency data AC, the data value of which become larger than zero for the first time, is assigned as the lowest luminance level $B_{LO}$,and a luminance level corresponding to accumulated frequency data AC, the data value of which becomes equal to "m" for the first time, is assigned as the highest luminance level $B_{HI}$. In other words, a range of $B_{LO}$ to $B_{HI}$ represents a luminance distribution of pixel data D in one display line as mentioned above. Then, the luminance distribution classifying circuit 303 determines which of classification A to classification D in FIG. 4, for example, the luminance distribution represented by the lowest luminance level $B_{LO}$ to the highest luminance level $B_{HI}$ falls under, and generates a luminance distribution classifying signal BC indicative of the determined classification. Specifically, the classification A in FIG. 4 corresponds to a luminance distribution extending over the full range of luminance levels from "0" to "255." The classification B in FIG. 4 corresponds to a luminance distribution extending in a low luminance range below a luminance level "50." The classification C in FIG. 4 corresponds to a luminance distribution extending in a middle luminance range of luminance levels from "30" to "150." The classification D in FIG. 4 corresponds to a luminance distribution extending in a high luminance range above the luminance level "50."

Figure 5:
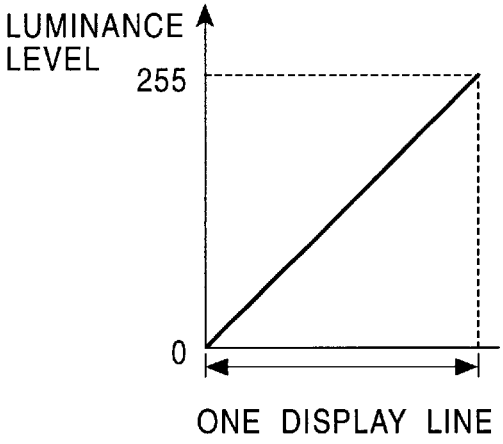
FIGS. 5 to 8 are graphs each showing an example of the luminance level of a video signal on one display line.
Figure 6:
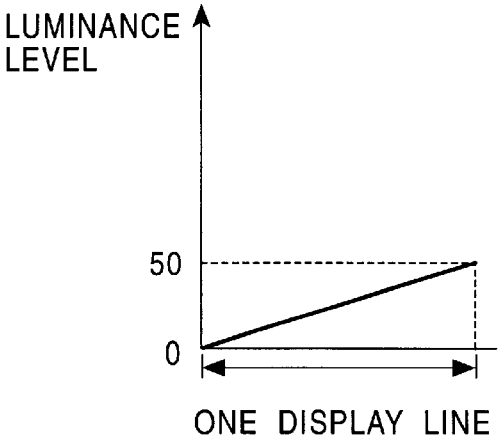
Figure 7:
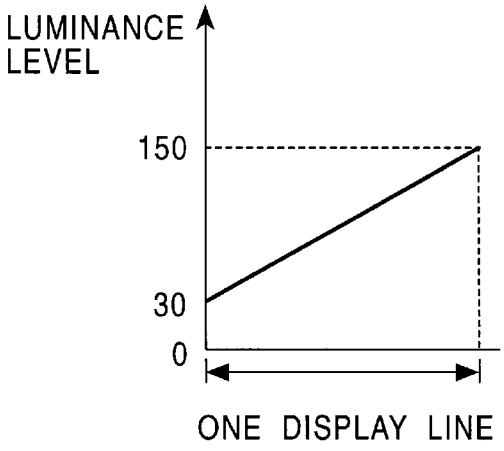
Figure 8:
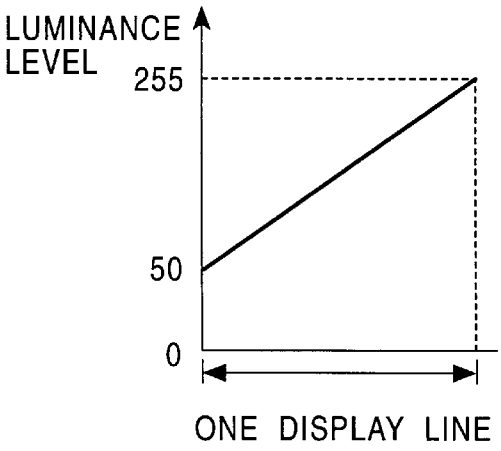

In the following, the operation of the 1H line luminance distribution analyzing circuit 3 having the configuration as described above will be described for an example in which the luminance level of m pixel data D for one display line transitions as shown in FIGS. 5 to 8. FIGS. 5 to 8 each show an image, the luminance of which gradually transitions to higher luminance from a left end to a right end of a screen on one display line. In this event, FIG. 5 shows that the luminance level uniformly appears on one display line at all the luminance levels from "0" to "255" which can be represented by 8-bit pixel data D. FIG. 6 shows that the luminance level uniformly appears on one display line in a range of luminance levels from "0" to "50." FIG. 7 shows that the luminance level uniformly appears on one display line in a range of luminance levels from "30" to "150." FIG. 8 shows that the luminance level uniformly appears on one display line in a range of luminance levels from "50" to "255."

Figure 9:
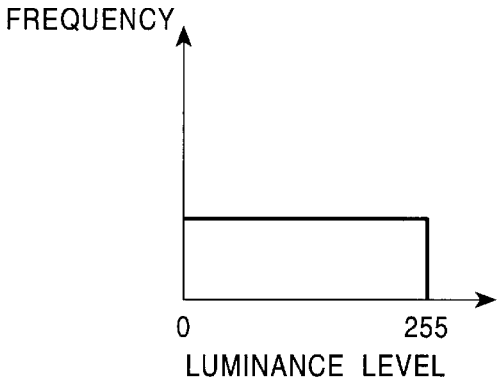
FIGS. 9 to 12 are graphs each showing an example of the frequency for each luminance level in one display line of a video signal.
Figure 13:
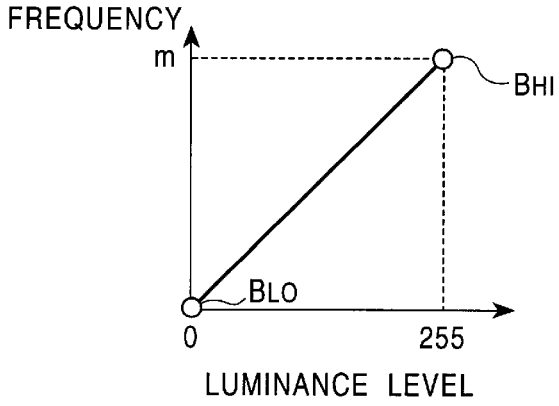
FIGS. 13 to 16 are graphs each showing an example of the accumulated frequency in one display line of a video signal.

Here, according to the pixel data D for one display line having the form as shown in FIG. 5, the frequency distribution of the respective luminance levels "0" to "255" is as shown in FIG. 9, and its accumulated frequency distribution is as shown in FIG. 13. In this event, the luminance distribution classifying circuit 303 allocates the luminance level "0" to the lowest luminance level $B_{LO}$, and the luminance level "255" to the highest luminance level $B_{HI}$, as shown in FIG. 13. Therefore, the luminance distribution in the luminance range of "0" to "255" represented by these levels $B_{LO}$, $B_{HI}$ falls under the classification A in FIG. 4. Accordingly, in this event, the luminance distribution classifying circuit 303 supplies the luminance distribution classifying signal BC indicative of the classification A to each of the drive control circuit 2 and the data converter circuit 30.

Figure 10:
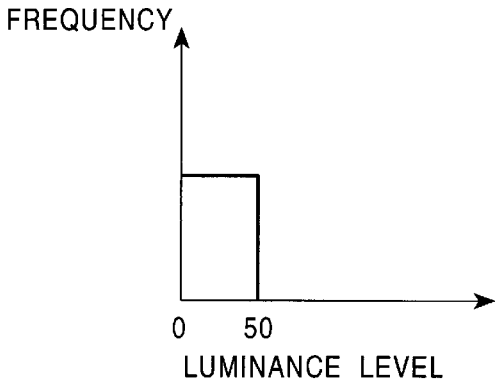
Figure 14:
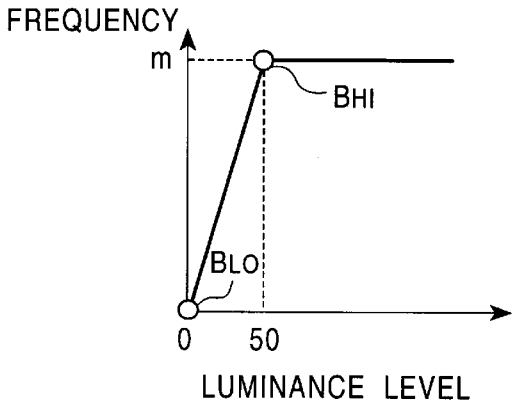

Also, according to the pixel data D for one display line having the form as shown in FIG. 6, the frequency distribution of the respective luminance levels "0" to "255" is as shown in FIG. 10, and its accumulated frequency distribution is as shown in FIG. 14. In this event, the luminance distribution classifying circuit 303 allocates the luminance level "0" to the lowest luminance level $B_{LO}$, and the luminance level "50" to the highest luminance level $B_{HI}$, as shown in FIG. 14. Therefore, the luminance distribution in the luminance range of "0" to "50" represented by these levels $B_{LO}$, $B_{HI}$ falls under the classification B in FIG. 4. Accordingly, in this event, the luminance distribution classifying circuit 303 supplies the luminance distribution classifying signal BC indicative of the classification B to each of the drive control circuit 2 and the data converter circuit 30.

Figure 11:
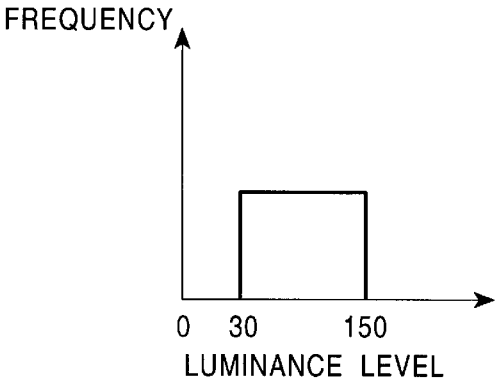
Figure 15:
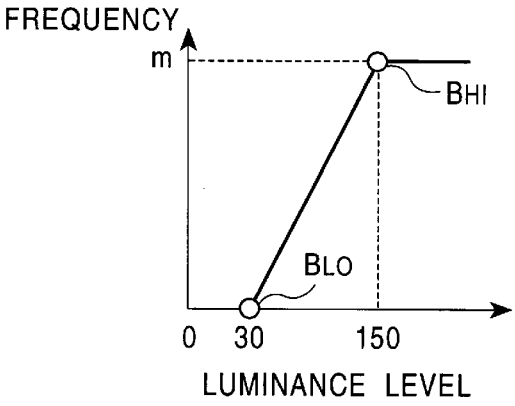

Further, according to the pixel data D for one display line having the form as shown in FIG. 7, the frequency distribution of the respective luminance levels "0" to "255" is as shown in FIG. 11, and its accumulated frequency distribution is as shown in FIG. 15. In this event, the luminance distribution classifying circuit 303 allocates the luminance level "30" to the lowest luminance level $B_{LO}$, and the luminance level "150" to the highest luminance level $B_{HI}$, as shown in FIG. 15. Therefore, the luminance distribution in the luminance range of "30" to "150" represented by these levels $B_{LO}$, $B_{HI}$ falls under the classification C in FIG. 4. Accordingly, in this event, the luminance distribution classifying circuit 303 supplies the luminance distribution classifying signal BC indicative of the classification C to each of the drive control circuit 2 and the data converter circuit 30.

Figure 12:
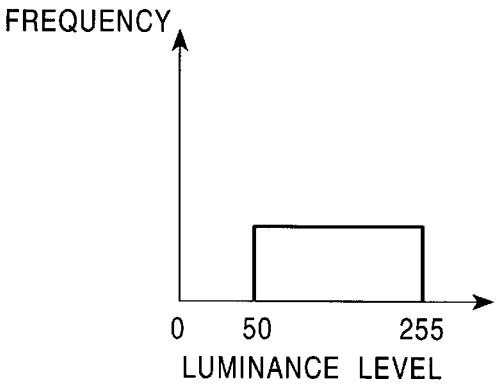
Figure 16:
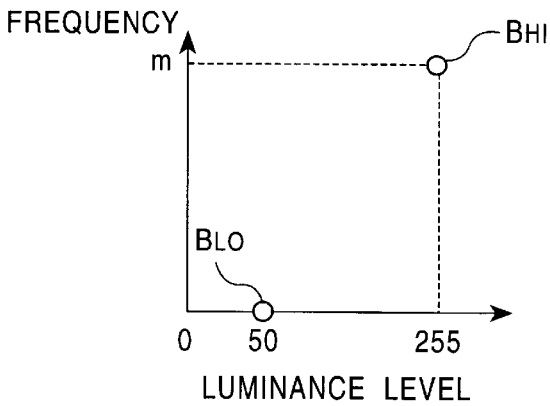

Finally, according to the pixel data D for one display line having the form as shown in FIG. 8, the frequency distribution of the respective luminance levels "0" to "255" is as shown in FIG. 12, and its accumulated frequency distribution is as shown in FIG. 16. In this event, the luminance distribution classifying circuit 303 allocates the luminance level "50" to the lowest luminance level $B_{LO}$, and the luminance level "255" to the highest luminance level $B_{HI}$, as shown in FIG. 16. Therefore, the luminance distribution in the luminance range of "50" to "255" represented by these levels $B_{LO}$, $B_{HI}$ falls under the classification D in FIG. 4. Accordingly, in this event, the luminance distribution classifying circuit 303 supplies the luminance distribution classifying signal BC indicative of the classification D to each of the drive control circuit 2 and the data converter circuit 30.

In the manner described above, the 1H line luminance distribution analyzing circuit 3 analyzes pixel data D of input one display line as to whether a luminance distribution represented thereby extends:

over the full luminance range (classification A);

within the low luminance range (classification B);

within the middle luminance range (classification C); or within the high luminance range (classification D) and supplies the luminance distribution classifying signal BC indicative of the resulting classification to each of the drive control circuit 2 and the data converter circuit 30.

Figure 17:
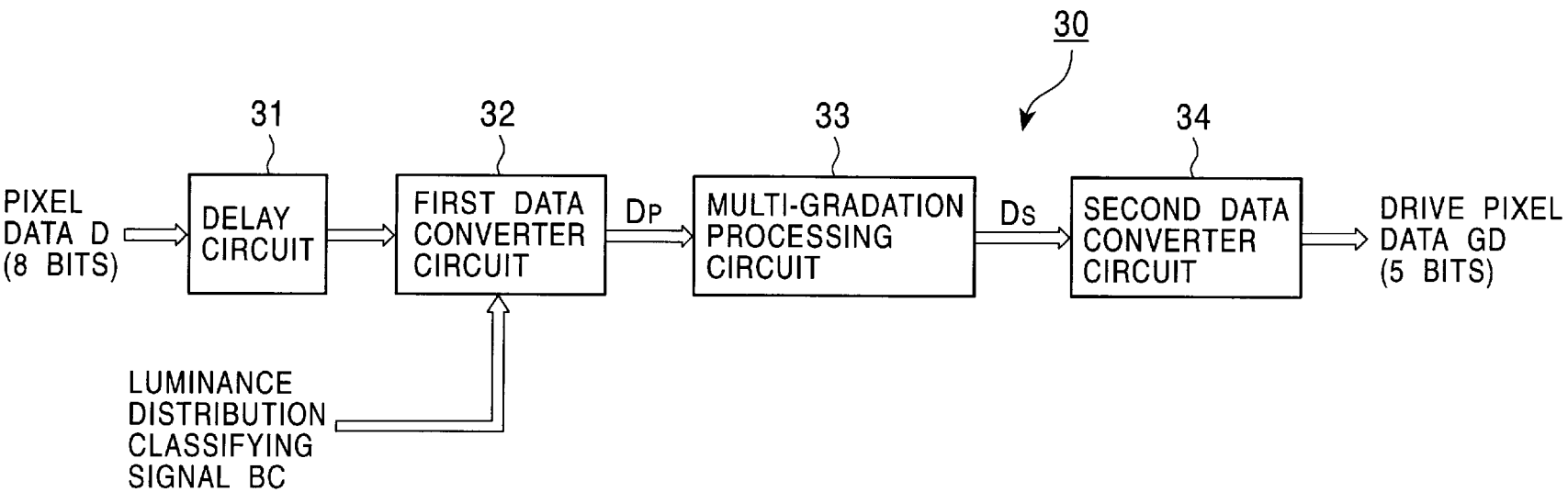
FIG. 17 is a block diagram illustrating the internal configuration of a data converter circuit 30.

FIG. 17 is a block diagram illustrating the internal configuration of the data converter circuit 30.

In FIG. 17, a delay circuit 31 delays pixel data D supplied from the A/D converter 1 by a predetermined time, and supplies the delayed pixel data D to a first data converter circuit 32. It should be noted that the predetermined time is equal to a time required by the 1H line luminance distribution analyzing circuit 3 for analyzing the luminance distribution of the pixel data for one display line.

The first data converter circuit 32 converts the 8-bit pixel data A which can represent 256 gradation luminance levels from "0" to "255" to luminance limited pixel data $D_P$ which is limited in luminance to a range of luminance levels from "0" to "160," and supplies the luminance limited pixel data $D_P$ to a multi-gradation processing circuit 33. The conversion characteristic of the first data converter circuit 32 conforms to a classification indicated by the luminance distribution classifying signal BC.

Figure 18:
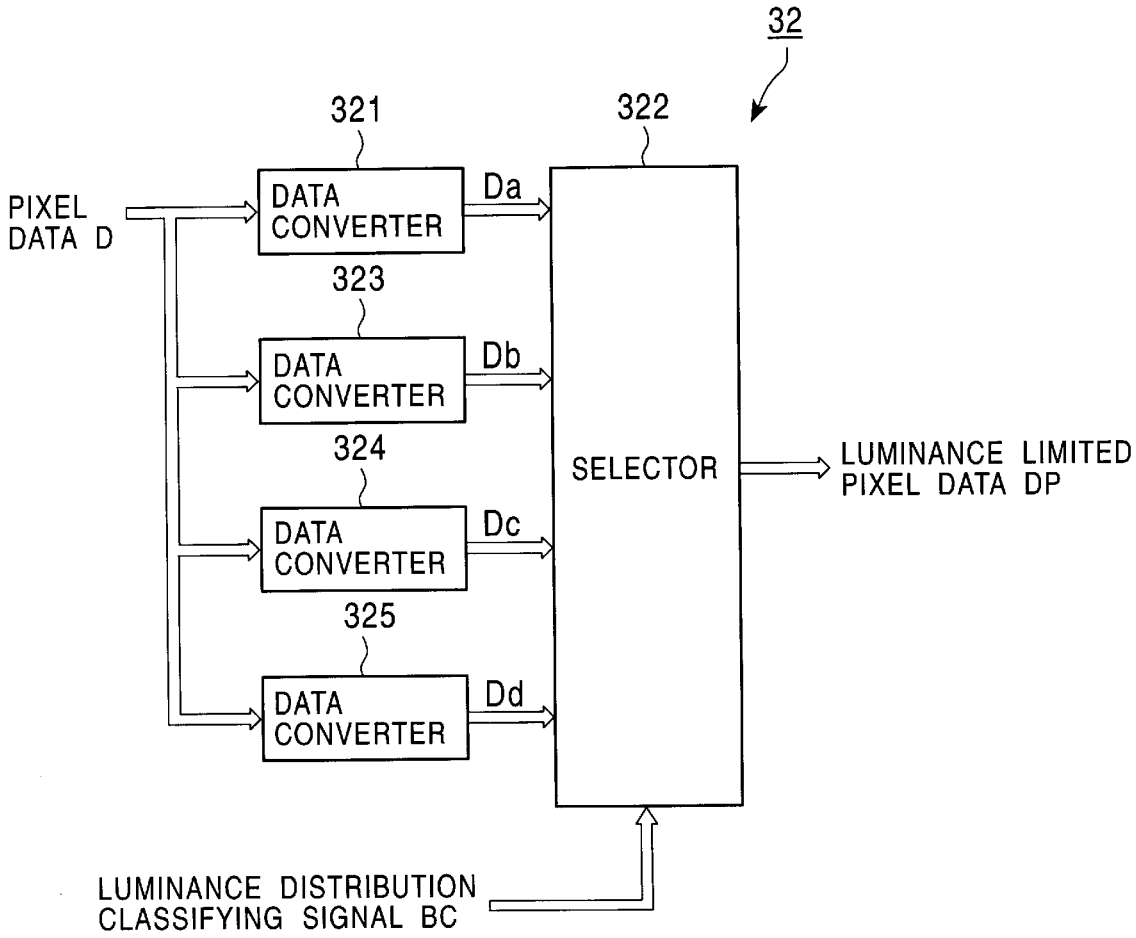
FIG. 18 is a block diagram illustrating the internal configuration of a first data converter circuit 32.

FIG. 18 is a block diagram illustrating the internal configuration of a first data converter circuit 32.

Figure 19:
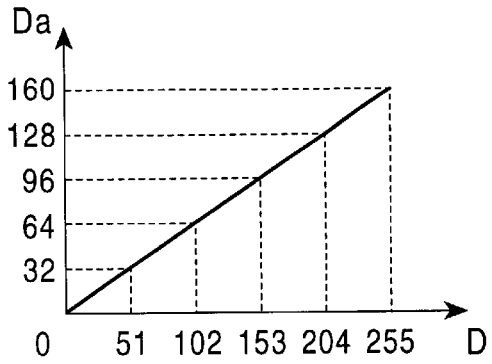
FIGS. 19 to 22 are graphs each showing a data conversion characteristic provided by the first data converter circuit 32.
Figure 20:
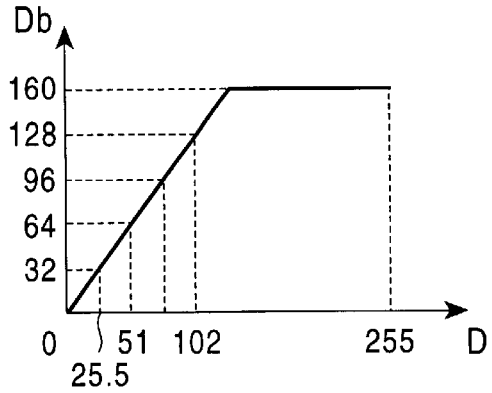
Figure 21:
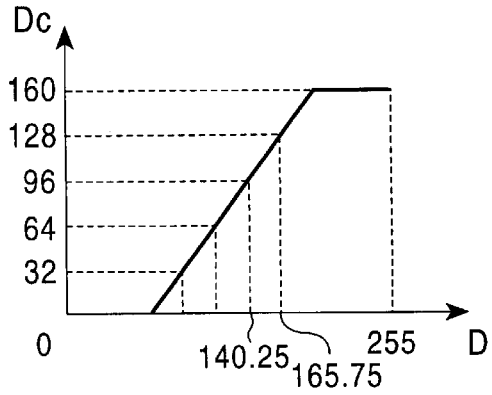
Figure 22:
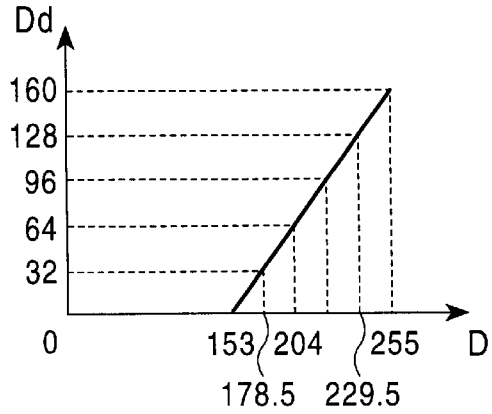

In FIG. 18, a data converter 321 converts the pixel data D to 8-bit pixel data Da having a luminance range from level "0" to level "160" in accordance with a conversion characteristic as shown in FIG. 19, and supplies the pixel data Da to a selector 322. A data converter 323 converts the pixel data D to 8-bit pixel data Db having a luminance range from level "0" to level "160" in accordance with a conversion characteristic as shown in FIG. 20, and supplies the pixel data Db to the selector 322. A data converter 324 converts the pixel data D to 8-bit pixel data DC having a luminance range from level "0" to level "160" in accordance with a conversion characteristic as shown in FIG. 21, and supplies the pixel data DC to the selector 322. A data converter 325 converts the pixel data D to 8-bit pixel data $D_d$ having a luminance range from level "0" to level "160" in accordance with a conversion characteristic as shown in FIG. 22, and supplies the pixel data $D_d$ to the selector 322. The selector 322 selects one from the pixel data $D_a$–$D_d$ which corresponds to a classification indicated by the luminance distribution classifying signal BC, and supplies the selected pixel data as luminance limited pixel data $D_P$ to the multi-gradation processing circuit 33 at the next process. Specifically, the selector 322 supplies the pixel data $D_a$ as the luminance limited pixel data $D_P$ to the multi-gradation processing circuit 33 when the luminance distribution classifying signal BC indicates the classification A in FIG. 4; the selector 322 supplies the pixel data $D_b$ as the luminance limited pixel data $D_P$ to the multi-gradation processing circuit 33 when the luminance distribution classifying signal BC indicates the classification B in FIG. 4; the selector 322 supplies the pixel data $D_c$ as the luminance limited pixel data $D_P$ to the multi-gradation processing circuit 33 when the luminance distribution classifying signal BC indicates the classification C in FIG. 4; and the selector 322 supplies the pixel data $D_d$ as the luminance limited pixel data $D_P$ to the multi-gradation processing circuit 33 when the luminance distribution classifying signal BC indicates the classification D in FIG. 4.

The multi-gradation processing circuit 33 applies multi-gradation processing such as error diffusion processing, dither processing and so on to the 8-bit luminance limited pixel data $D_P$ which has undergone the luminance limitation in the first data converter circuit 32. In this way, the multi-gradation processing circuit 33 generates multi-gradation pixel data $D_S$ which has its number of bits compressed to three bits while substantially maintaining the number of gradation representation levels of visually perceived luminance to 256 gradation levels. First, in the error diffusion processing, the luminance limited pixel data $D_P$ is separated into upper six bits as display data and the remaining lower two bits as error data. Then, the error data derived from the luminance limited pixel data $D_P$ corresponding to respective peripheral pixels are added with weighting. The resulting data is reflected to the display data. This operation causes the luminance of the lower two bits in the original pixel to be virtually represented by the peripheral pixel, so that a luminance gradation representation equivalent to the 8-bit pixel data can be provided by display data comprised of six bits which are less than eight bits. Next, the 6-bit error diffusion processed pixel data resulting from the error diffusion processing is applied with the dither processing to generate the multi-gradation pixel data $D_S$ which has the number of bits reduced to three bits while maintaining the luminance gradation levels equivalent to the error diffusion processed pixel data. In this event, the dither processing involves representing one intermediate display level by treating a plurality of adjacent pixels as one pixel unit. For example, a plurality of mutually adjacent pixels are marked off as one pixel unit, and dither coefficients having coefficient values different from one another are allocated to pixel data corresponding to the respective pixels in this pixel unit, and the-resulting pixel data are added. According to the dither addition as mentioned, even with only the upper three bits of each pixel data, a luminance corresponding to the remaining lower three bits can be represented when viewed in the pixel unit.

The 3-bit multi-gradation pixel data $D_S$ eventually generated by the error diffusion processing and the dither processing as described above is supplied to a second data converter circuit 34.

The second data converter circuit 34 converts the multi-gradation pixel data $D_S$ to 5-bit (first to fifth bits) drive pixel data GD for driving one pixel in accordance with a conversion table as shown in FIG. 23, and supplies the drive pixel data GD to a memory 4 shown in FIG. 1.

The memory 4 sequentially stores the drive pixel data GD in response to a write signal supplied from the drive control circuit 2. As the drive pixel data GD have been written into the memory 4 for one screen (n rows, m columns) on the PDP 10 by the write operation, the drive pixel data $GD_{11}$–$GD_{nm}$ for one screen are divided into respective bit digits as follows:

| | |
|---|---|
| $DB1_{11}$–$DB1_{nm}$: | first bits of respective $GD_{11}$–$GD_{nm}$; |
| $DB2_{11}$–$DB2_{nm}$: | second bits of respective $GD_{11}$–$GD_{nm}$; |
| $DB3_{11}$–$DB3_{nm}$: | third bits of respective $GD_{11}$–$GD_{nm}$; |
| $DB4_{11}$–$DB4_{nm}$: | fourth bits of respective $GD_{11}$–$GD_{nm}$; |
| $DB5_{11}$–$DB5_{nm}$: | fifth bits of respective $GD_{11}$–$GD_{nm}$; |

and memory 4 regards them as drive pixel data bits DB1–DB5, and sequentially reads each of the drive pixel data bits DB1–DB5 for each row in response to a read signal supplied from the drive control circuit 2 for supply to an address driver 6. Specifically, the memory 4 first sequentially reads the drive pixel data bits $DB1_{11}$–$DB1_{nm}$ for each row, and next sequentially reads the pixel data bits $DB2_{11}$–$DB2_{nm}$ for each row.

Figure 24:
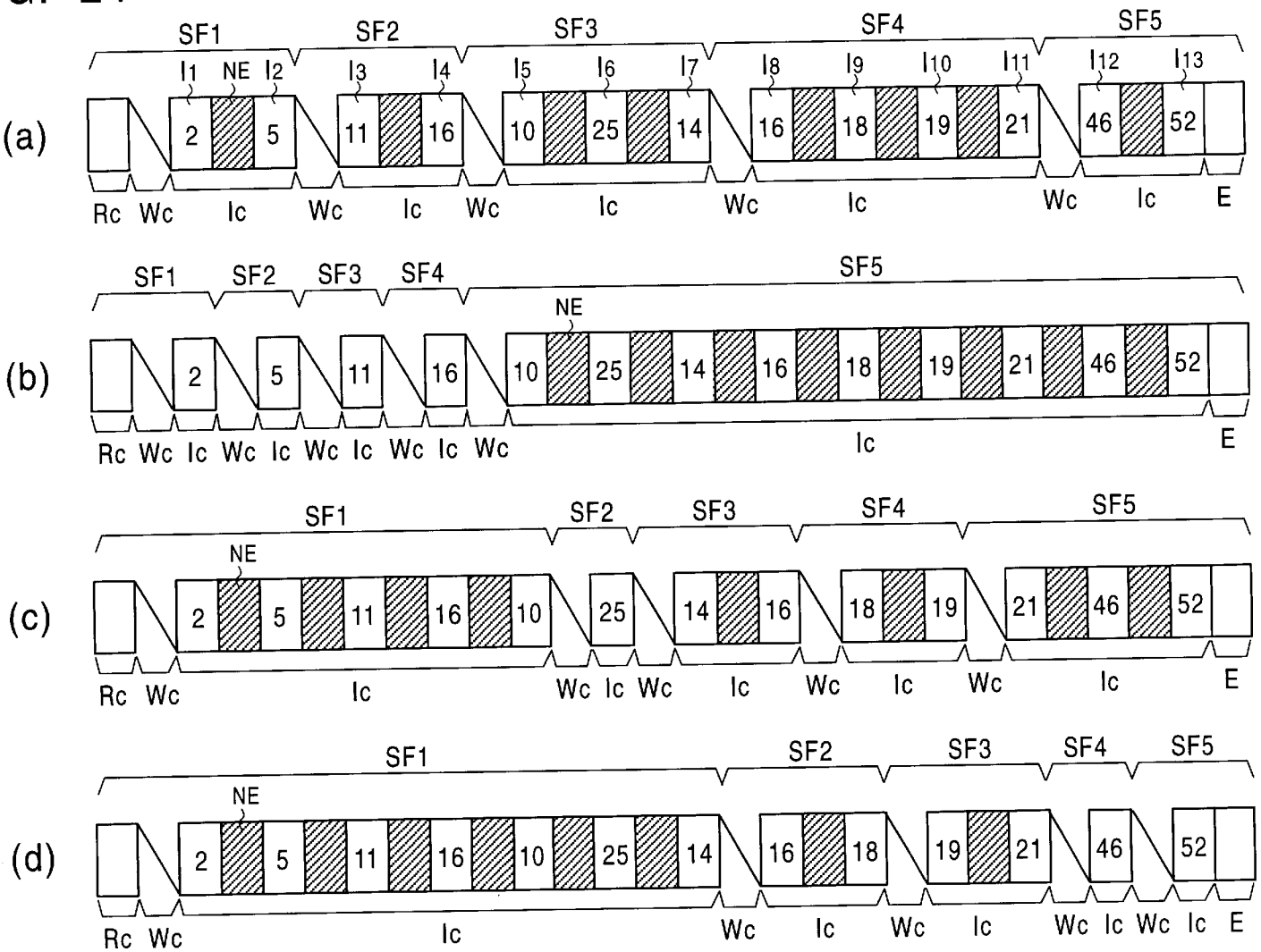
FIG. 24 includes diagrams each illustrating an example of light emission driving format based on a driving method according to the present invention.

The drive control circuit 2 selects a light emission driving format in accordance with a luminance distribution classification indicated by the luminance distribution classifying signal BC from among light emission driving formats illustrated in sections (a)–(d) of FIG. 24. Then, the driver control circuit 2 supplies a variety of timing signals required for driving the PDP 10 in accordance with the selected light emission driving format to each of the address driver 6, first sustain driver 7 and second sustain driver 8.

In the driving formats illustrated in the sections (a)–(d) of FIG. 24, a simultaneous reset process Rc for simultaneously initializing all discharge cells of the PDP 10 to either a "light emitting cell" or a "non-light emitting cell" and a pixel data writing process Rc for sequentially writing pixel data for all display lines are sequentially performed at the beginning of one field display period. Subsequently, 13 divisional light emission sustain processs $I_1$–$I_{13}$ are intermittently performed with the following light emission frequency ratio:

2: 5: 11: 16: 10: 25: 14: 16: 18: 19: 21: 46: 52

Here, when the light emission driving format illustrated in the section (a) of FIG. 24 is selected, the pixel data writing process Wc is performed between the simultaneous reset process Rc and the divisional light emission sustain process $I_1$; between the divisional light emission sustain processs $I_2$ and $I_3$; between the divisional light emission sustain processs $I_4$ and $I_5$; between the divisional light emission sustain processs $I_7$ and $I_8$; and between the divisional light emission sustain processs $I_{11}$ and $I_{12}$.

When the light emission driving format illustrated in the section (b) of FIG. 24 is selected, the pixel data writing process Wc is performed between the simultaneous reset process Rc and the divisional light emission sustain process $I_1$; between the divisional light emission sustain processs $I_1$ and $I_2$; between the divisional light emission sustain processs $I_2$ and $I_3$; between the divisional light emission sustain processs $I_3$ and $I_4$; and between the divisional light emission sustain processs $I_4$ and $I_5$ When the light emission driving format illustrated in the section (c) of FIG. 24 is selected, the pixel data writing process Wc is performed between the simultaneous reset process Rc and the divisional light emission sustain process $I_1$; between the divisional light emission sustain processs $_5$ and $I_6$; between the divisional light emission sustain processs $I_6$ and $I_7$; between the divisional light emission sustain processs $I_8$ and $I_9$; and between the divisional light emission sustain processs $I_{10}$ and $I_{11}$.

When the light emission driving format illustrated in the section (d) of FIG. 24 is selected, the pixel data writing process Wc is performed between the simultaneous reset process Rc and the divisional light emission sustain process $I_1$; between the divisional light emission sustain processs $I_7$ and $I_8$; between the divisional light emission sustain processs $I_9$ and $I_{10}$; between the divisional light emission sustain processs $I_{11}$ and $I_{12}$; and between the divisional light emission sustain processs $I_{12}$ and $I_{13}$.

In other words, between the simultaneous reset process Rc and the divisional light emission sustain process $I_1$, the pixel data is written for all the display lines.

Figure 4:
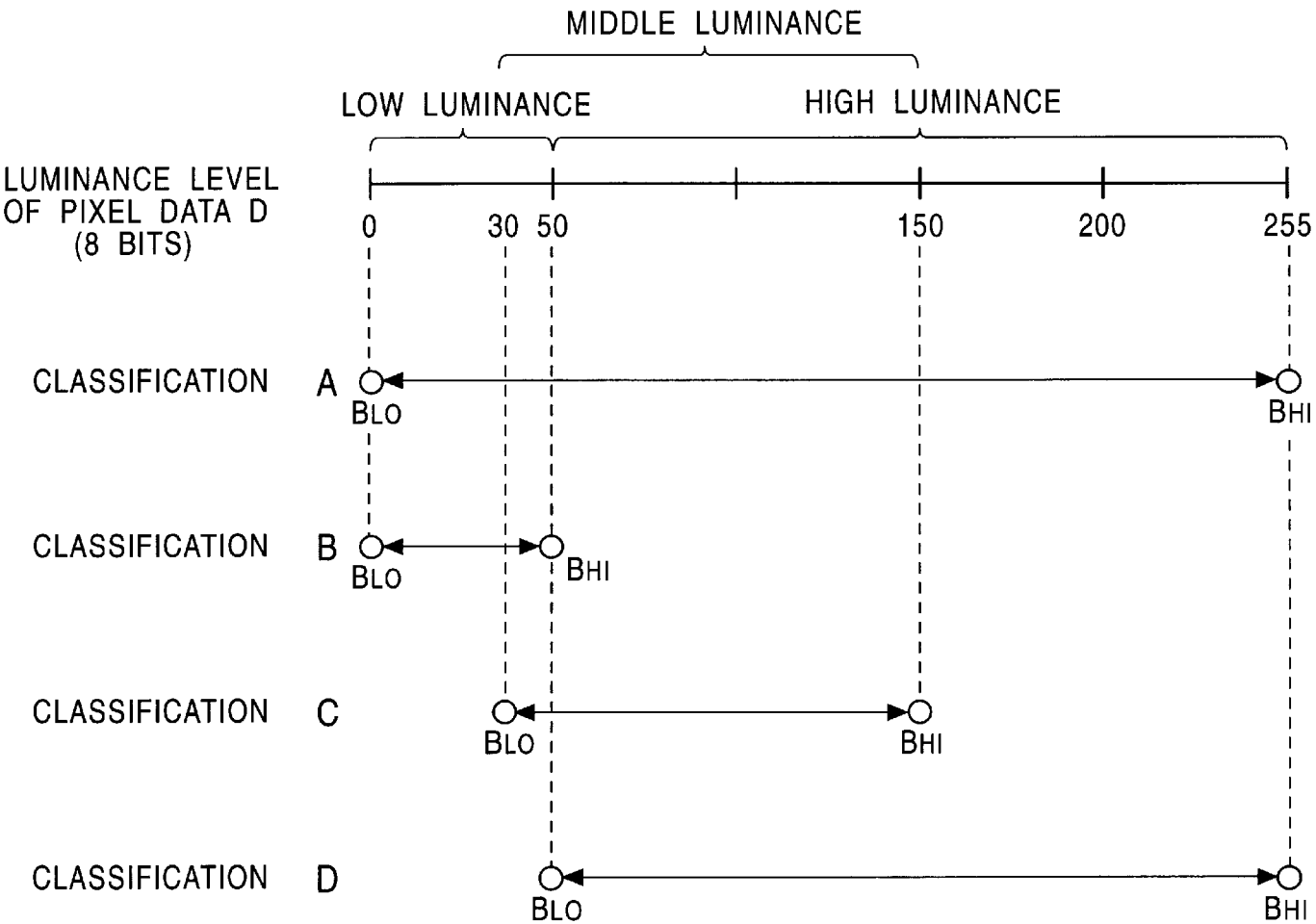
FIG. 4 is a diagram showing an exemplary classification form for a luminance distribution in a luminance distribution classifying circuit 303.

Between the divisional light emission sustain processs $I_1$ and $I_2$, only for a display line which falls under the classification B in FIG. 4 as indicated by the luminance distribution classifying signal BC, the pixel data writing process Wc is performed for setting each of discharge cells on the display line to a "light emitting cell" or a "non-light emitting cell" in accordance with pixel data. In this event, display lines which fall under the classifications A, C, D in FIG. 4 as indicated by the luminance distribution classifying signal BC are skipped without performing write scanning.

Between the divisional light emission sustain processs $I_2$ and $I_3$, only for a display line which falls under the classification A in FIG. 4 as indicated by the luminance distribution classifying signal BC and a display line which falls under the classification B in FIG. 4 as indicated by the luminance distribution classifying signal BC, the pixel data writing process Wc is performed for setting each of discharge cells on the display lines to a "light emitting cell" or a "non-light emitting cell" in accordance with pixel data. In this event, display lines which fall under the classifications C, D in FIG. 4 as indicated by the luminance distribution classifying signal BC are skipped without performing the write scanning.

Between the divisional light emission sustain processs $I_3$ and $I_4$, only for a display line which falls under the classification B in FIG. 4 as indicated by the luminance distribution classifying signal BC, the pixel data writing process Wc is performed for setting each of discharge cells on the display line to a "light emitting cell" or a "non-light emitting cell" in accordance with pixel data. In this event, display lines which fall under the classifications A, C, D in FIG. 4 as indicated by the luminance distribution classifying signal BC are skipped without performing the write scanning.

Between the divisional light emission sustain processs $I_4$ and $I_5$, only for a display line which falls under the classification A in FIG. 4 as indicated by the luminance distribution classifying signal BC and a display line which falls under the classification B in FIG. 4 as indicated by the luminance distribution classifying signal BC, the pixel data writing process Wc is performed for setting each of discharge cells on the display lines to a "light emitting cell" or a "non-light emitting cell" in accordance with pixel data. In this event, display lines which fall under the classifications C, D in FIG. 4 as indicated by the luminance distribution classifying signal BC are skipped without performing the write scanning.

Between the divisional light emission sustain processs $I_5$ and $I_6$, only for a display line which falls under the classification B in FIG. 4 as indicated by the luminance distribution classifying signal BC, the pixel data writing process Wc is performed for setting each of discharge cells on the display line to a "light emitting cell" or a "non-light emitting cell" in accordance with pixel data. In this event, display lines which fall under the classifications A, C, D in FIG. 4 as indicated by the luminance distribution classifying signal BC are skipped without performing the write scanning.

Between the divisional light emission sustain processs $I_6$ and $I_7$, only for a display line which falls under the classification C in FIG. 4 as indicated by the luminance distribution classifying signal BC, the pixel data writing process Wc is performed for setting each of discharge cells on the display line to a "light emitting cell" or a "non-light emitting cell" in accordance with pixel data. In this event, display lines which fall under the classifications A, B, D in FIG. 4 as indicated by the luminance distribution classifying signal BC are skipped without performing the write scanning.

Between the divisional light emission sustain processs $I_7$ and $I_8$, only for a display line which falls under the classification A in FIG. 4 as indicated by the luminance distribution classifying signal BC and a display line which falls under the classification D in FIG. 4 as indicated by the luminance distribution classifying signal BC, the pixel data writing process Wc is performed for setting each of discharge cells on the display lines to a "light emitting cell" or a "non-light emitting cell" in accordance with pixel data. In this event, display lines which fall under the classifications B, C in FIG. 4 as indicated by the luminance distribution classifying signal BC are skipped without performing the write scanning.

Between the divisional light emission sustain processs $I_8$ and $I_9$, only for a display line which falls under the classification C in FIG. 4 as indicated by the luminance distribution classifying signal BC, the pixel data writing process Wc is performed for setting each of discharge cells on the display line to a "light emitting cell" or a "non-light emitting cell" in accordance with pixel data. In this event, display lines which fall under the classifications A, B, D in FIG. 4 as indicated by the luminance distribution classifying signal BC are skipped without performing the write scanning.

Between the divisional light emission sustain processs $I_9$ and $I_{10}$, only for a display line which falls under the classification D in FIG. 4 as indicated by the luminance distribution classifying signal BC, the pixel data writing process Wc is performed for setting each of discharge cells on the display line to a "light emitting cell" or a "non-light emitting cell" in accordance with pixel data. In this event, display lines which fall under the classifications A, B, C in FIG. 4 as indicated by the luminance distribution classifying signal BC are skipped without performing the write scanning.

Between the divisional light emission sustain processs $I_{10}$ and $I_{11}$, only for a display line which falls under the classification C in FIG. 4 as indicated by the luminance distribution classifying signal BC, the pixel data writing process Wc is performed for setting each of discharge cells on the display line to a "light emitting cell" or a "non-light emitting cell" in accordance with pixel data. In this event, display lines which fall under the classifications A, B, D in FIG. 4 as indicated by the luminance distribution classifying signal BC are skipped without performing the write scanning.

Between the divisional light emission sustain processs $I_{11}$ and $I_{12}$, only for a display line which falls under the classification A in FIG. 4 as indicated by the luminance distribution classifying signal BC and a display line which falls under the classification D in FIG. 4 as indicated by the luminance distribution classifying signal BC, the pixel data writing process Wc is performed for setting each of discharge cells on the display lines to a "light emitting cell" or a "non-light emitting cell" in accordance with pixel data. In this event, display lines which fall under the classifications B, C in FIG. 4 as indicated by the luminance distribution classifying signal BC are skipped without performing the write scanning.

Between the divisional light emission sustain processs $I_{12}$ and $I_{13}$, only for a display line which falls under the classification D in FIG. 4 as indicated by the luminance distribution classifying signal BC, the pixel data writing process Wc is performed for setting each of discharge cells on the display line to a "light emitting cell" or a "non-light emitting cell" in accordance with pixel data. In this event, display lines which belong to the classifications A, B, C in FIG. 4 as indicated by the luminance distribution classifying signal BC are skipped without performing the write scanning.

It should be noted that each divisional light emission sustain process is provided with a non-light emitting period NE, as indicated by hatchings in FIG. 24, which is equal to a time spent for the write scanning.

Therefore, when the divisional light emission sustain processs, without the write scanning performed therebetween, are grouped into a single light emission sustain process Ic, one field display period is comprised of five subfields SF1–SF5 in each of the light emission driving formats illustrated in the sections (a)–(d) of FIG. 24. In other words, a total number of times of the write scanning for one display line is five. Since the number of times of the write scanning within one field display period (five times x number of all display lines) is constant at all times, a total time spent for the write scanning (the pixel data writing process Wc) is also constant at all times if lines which are not scanned for writing are instantaneously skipped. It is therefore possible to improve the gradation representation capability without increasing the number of times of write scanning and a time period required therefor, as compared with the conventional driving method.

Each of the address driver 6, first sustain driver 7 and second sustain driver 8 applies a variety of driving pulses to each of column electrodes $D_1$–$D_m$ and row electrodes $X_1$–$X_n$ and $Y_1$–$Y_n$ of the PDP 10 for implementing the aforementioned operation in each of the simultaneous reset process Rc, pixel data writing process Wc, light emission sustain process Ic and erasure process E.

Figure 25:
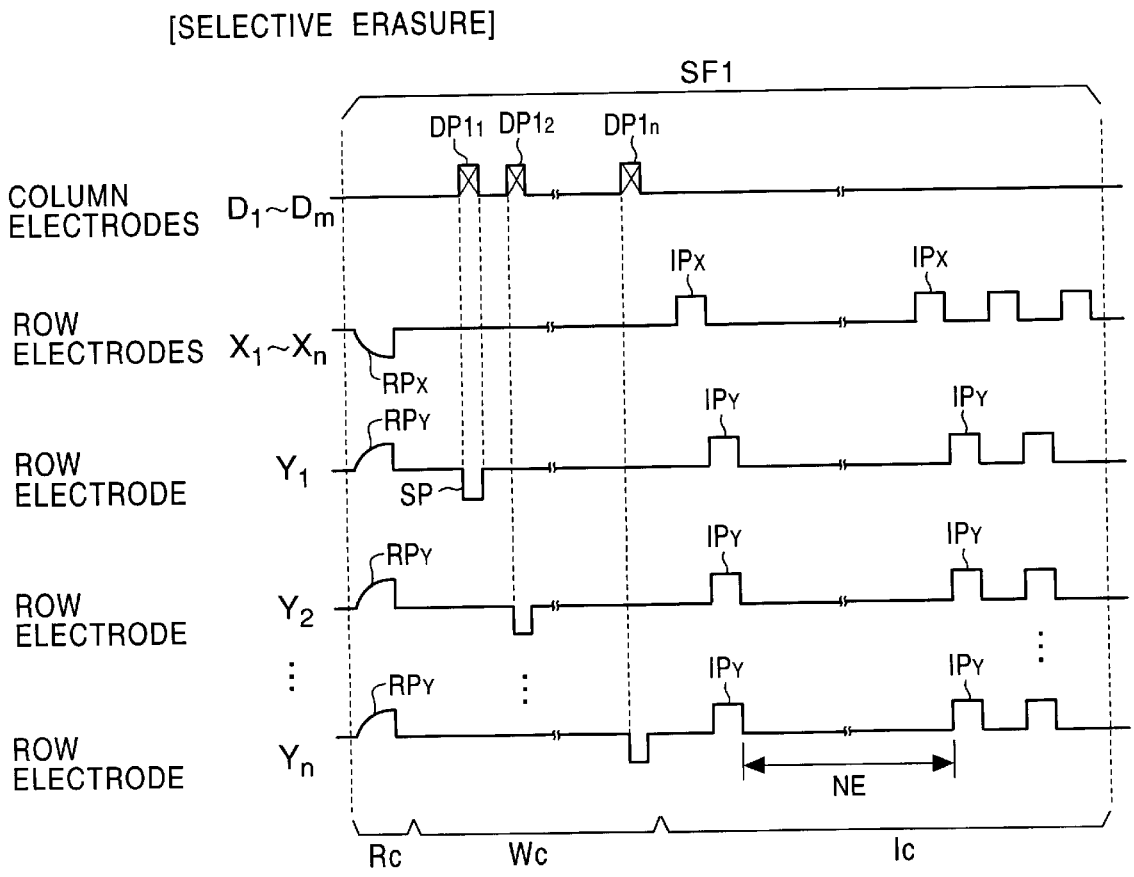
FIG. 25 is a waveform diagram showing application timings at which a variety of driving pulse are applied for driving a PDP 10 to display in gradation representation in accordance with the light emission driving formats illustrated in sections (a) to (d) of FIG. 24.

FIG. 25 is a waveform chart showing exemplary timings at which such driving pulses are applied.

It should be noted that FIG. 25 only shows application timings of driving pulses in the first subfield SF1 extracted from the light emission driving format illustrated in the section (a) of FIG. 24.

First, in the simultaneous reset process Rc, the first sustain driver 7 generates the reset pulse $RP_X$ of negative polarity, while the second sustain driver 8 generates the reset pulse $RP_Y$ of positive polarity. These reset pulses are simultaneously applied to the row electrodes $X_1$–$X_n$ and $Y_1$–$Y_n$, respectively. The application of these reset pulses $RP_X$, $RP_Y$ causes all the discharge cells in the PDP 10 to be reset or discharged to forcedly form a uniform wall charge in each of the discharge cells. In other words, all the discharge cells in the PDP 10 are once initialized to "light emitting cells."

Next, in the pixel data writing process Wc, the address driver 6 generates a pixel data pulse having a voltage corresponding to a logical level of the drive pixel data bit DB supplied from the memory 4, and supplies the pixel data pulses for each display line to the column electrodes $D_1$–$D_m$. Specifically, in the subfield SF1, data corresponding to the first line, i.e., $DB1_{11}$, $DB1_{12}$, $DB1_{13}$, . . . $DB1_{1m}$ are extracted from the drive pixel data bits DB1. Then, a pixel data pulse group $DP1_1$ comprised of m pixel data pulses corresponding to logical levels of the respective drive pixel data bits DB1 is generated and applied to a column electrode $D_{1-m}$. Next, data corresponding to the second line, i.e., $DB1_{21}$, $DB1_{22}$, $DB1_{23}$, . . . $DB1_{2m}$ are extracted from the drive pixel data bits DB1. Then, a pixel data pulse group $DP1_2$ comprised of m pixel data pulses corresponding to logical levels of the respective drive pixel data bits DB1 is generated and applied to a column electrode $D_{1-m}$. Subsequently, in a similar manner, pixel data pulse groups $DP1_3$–$DP1_n$ for each display line are sequentially applied to the column electrodes $D_1$–$D_m$. Assume herein that the address driver 6 generates a pixel data pulse at a high voltage when drive pixel data bit DB is at logical level "1" and generates a pixel data pulse at a low voltage (zero volt) when drive pixel data bit DB is at logical level "0."

Further, in the pixel data writing process Wc, the second sustain driver 8 sequentially applies a scanning pulse SP of negative polarity to the row electrodes $Y_1$–$Y_n$ at the same timing at which each pixel data pulse group DP is applied, as shown in FIG. 25. In this event, the discharge (selective writing discharge) occurs only in discharge cells at intersections of "rows" applied with the scanning pulse SP with "columns" applied with the pixel data pulse at the high voltage to selectively extinguish the wall charges formed in the discharge cells. Specifically, the logical level at each of the first to fifth bits in the drive pixel data GD as shown in FIG. 23 determines whether or not the selective erasure discharge is produced in the pixel data writing process Wc in each of the subfields SF1–SF5. This selective writing discharge as described causes the discharge cells initialized to the "light emitting cell" state in the simultaneous reset process Rc to transition to the "non-light emitting cells." On the other hand, the selective writing discharge as described above is not produced in discharge cells formed in a column which has not been applied with the pixel data pulse at the high voltage, so that these discharge cells are maintained in the initialized state in the simultaneous reset process Rc, i.e., the "light emitting cell" state. In this way, the pixel data writing process Wc performed in each subfield causes each of the discharge cells to be set to a "light emitting cell" in which the sustain discharge is produced in the subsequent light emission sustain process Ic or a "non-light emitting cell" in which no sustain discharge is produced.

Next, in the light emission sustain process Ic, the first sustain driver 7 and the second sustain driver 8 alternately apply the sustain pulses $IP_X$, $IP_Y$ of positive polarity to the row electrodes $X_1$–$X_n$ and $Y_1$–$Y_n$, as illustrated in FIG. 25. It should be noted that the first and second sustain drivers 7, 8 stop applying the sustain pulses $IP_X$, $IP_Y$ in the non-light emitting period NE, and resume alternately applying the sustain pulses $IP_X$, $IP_Y$ after the non-light emitting period NE. In this event, only in the discharge cells in which the wall charges remain in the pixel data writing process Wc, i.e., in the "light emitting cells," the sustain discharge is produced each time they are applied with the sustain pulses $IP_X$, $IP_Y$. In other words, while the sustain discharge is intermittently produced, a light emitting state associated with the sustain discharge is sustained.

The pixel data writing process Wc and the light emission sustain process Ic as described above are performed as well in the remaining subfields SF2–SF5. In this event, the number of times the sustain pulses IP are applied in the light emission sustain process Ic of each subfield depends on a light emission driving format employed by the drive control circuit 2.

Specifically, when the luminance distribution classifying signal BC indicates the classification A in FIG. 4, the drive control circuit 2 performs light emission driving in accordance with the light emission driving format illustrated in the section (a) of FIG. 24. Accordingly, each of the first sustain driver 7 and the second sustain driver 8 applies the sustain pulse IP the following number of times in each of the subfields:

SF1: 7 (the total number of light emissions in the divisional light emission sustain processs $I_1$–$I_2$);

SF2: 27 (the total number of light emissions in the divisional light emission sustain processs $I_3$–$I_4$);

SF3: 49 (the total number of light emissions in the divisional light emission sustain processs $I_5$–$I_7$);

SF4: 74 (the total number of light emissions in the divisional light emission sustain processs $I_8$–$I_{11}$); and SF5: 98 (the total number of light emissions in the divisional light emission sustain processs $I_{12}$–$I_{13}$).

When the luminance distribution classifying signal BC indicates the classification B in FIG. 4, i.e., when a luminance distribution of one display line lies in the low luminance range, the drive control circuit 2 performs light emission driving in accordance with the light emission driving format illustrated in the section (b) of FIG. 24.

Accordingly, each of the first sustain driver 7 and the second sustain driver 8 applies the sustain pulse IP the following number of times in each of the subfields:

SF1: 2 (the number of light emissions in the divisional light emission sustain process $I_1$);

SF2: 5 (the number of light emissions in the divisional light emission sustain process $I_2$);

SF3: 11 (the number of light emissions in the divisional light emission sustain process $I_3$);

SF4: 16 (the number of light emissions in the divisional light emission sustain process $I_4$); and SF5: 221 (a total number of light emission in the divisional light emission sustain processs $I_5$–$I_{13}$).

When the luminance distribution classifying signal BC indicates the classification C in FIG. 4, i.e., when a luminance distribution of one display line lies in the middle luminance range, the drive control circuit 2 performs light emission driving in accordance with the light emission driving format illustrated in the section (c) of FIG. 24. Accordingly, each of the first sustain driver 7 and the second sustain driver 8 applies the sustain pulse IP the following number of times in each of the subfields:

SF1: 44 (the total number of light emissions in the divisional light emission sustain processs $I_1$–$I_5$)

SF2: 25 (the number of light emissions in the divisional light emission sustain process $I_6$);

SF3: 30 (the total number of light emissions in the divisional light emission sustain processs $I_7$–$I_8$);

SF4: 37 (the total number of light emissions in the divisional light emission sustain processs $I_9$–$I_{10}$); and SF5: 119 (the total number of light emissions in the divisional light emission sustain processs $I_{11}$–$I_{13}$).

When the luminance distribution classifying signal BC indicates the classification D in FIG. 4, i.e., when a luminance distribution of one display line lies in the high luminance range, the drive control circuit 2 performs light emission driving in accordance with the light emission driving format illustrated in the section (d) of FIG. 24. Accordingly, each of the first sustain driver 7 and the second sustain driver 8 applies the sustain pulse IP the following number of times in each of the subfields:

SF1: 83 (the total number of light emissions in the divisional light emission sustain processs $I_1$–$I_7$);

SF2: 34 (the total number of light emissions in the divisional light emission sustain processs $I_8$–$I_9$):

SF3: 40 (the total number of light emissions in the divisional light emission sustain processs $I_{10}$–$I_{11}$);

SF4: 46 (the number of light emissions in the divisional light emission sustain process $I_{12}$); and SF5: 52 (the total number of light emissions in the divisional light emission sustain process $I_{13}$).

Stated another way, the drive control circuit 2 changes the number of light emissions to be allocated to the light emission sustain process Ic in each subfield in accordance with the luminance distribution in an input video signal for one display line.

In this way, a display at a luminance in accordance with the total number of sustain discharges produced in the light emission sustain process Ic in each of the subfields SF1–SF5 appears on the screen of the PDP 10. It should be noted that whether or not the sustain discharge as described above is produced in the light emission sustain process Ic in each subfield is determined depending on whether or not the selective erasure discharge is produced in the pixel data writing process Wc in the subfield. According to drive pixel data GD in FIG. 23, the selective erasure discharge is produced in the pixel data writing process Wc only in one of the subfields SF1–SF5 within one field, as indicated by black circles. Therefore, the wall charges formed in the simultaneous reset process Rc in the first subfield SF1 remain until the selective erasure discharge is produced, thereby allowing each of the discharge cells to sustain the "light emitting cell" state. In other words, the sustain discharge, causing light emission, is produced in the light emission sustain process Ic in each of the subfields (indicated by white circles) intervening therebetween. Since there are six possible patterns for the drive pixel data GD as shown in FIG. 23, six light emission driving patterns are provided in accordance with these patterns. Thus, six intermediate luminance levels different from one another are represented by these six light emission driving patterns.

In this event, when the luminance distribution classifying signal BC indicates the classification A in FIG. 4, the gradation driving based on the light emission driving format illustrated in the section (a) of FIG. 24 (hereinafter referred to as the "driving mode a") is performed, so that the following six intermediate display luminance levels are provided in this event according to the six light emission driving patterns shown in FIG. 23:

{0, 7, 34, 83, 157, 255}

On the other hand, when the luminance distribution classifying signal BC indicates the classification B in FIG. 4, the gradation driving based on the light emission driving format illustrated in the section (b) of FIG. 24 (hereinafter referred to as the "driving mode b") is performed, so that the following six intermediate display luminance levels are provided in this event according to the six light emission driving patterns shown in FIG. 23:

{0, 2, 7, 18, 34, 255}

Also, when the luminance distribution classifying signal BC indicates the classification C in FIG. 4, the gradation driving based on the light emission driving format illustrated in the section (c) of FIG. 24 (hereinafter referred to as the "driving mode c") is performed, so that the following six intermediate display luminance levels are provided in this event according to the six light emission driving patterns shown in FIG. 23:

{0, 44, 69, 99, 136, 255}

Further, when the luminance distribution classifying signal BC indicates the classification D in FIG. 4, the gradation driving based on the light emission driving format illustrated in the section (d) of FIG. 24 (hereinafter referred to as the "driving mode d") is performed, so that the following six intermediate display luminance levels are provided in this event according to the six light emission driving patterns shown in FIG. 23:

{0, 83, 117, 157, 203, 255}

Figure 26:
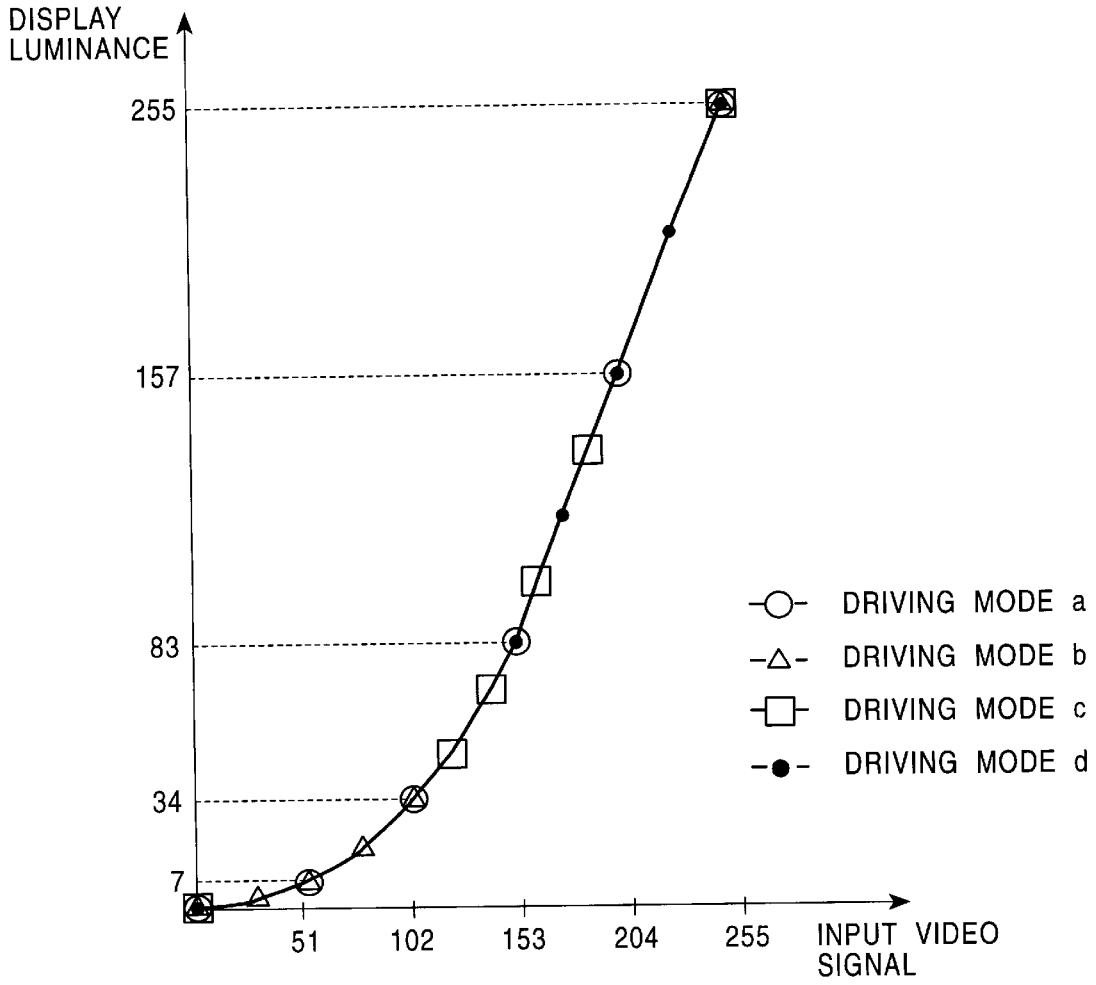
FIG. 26 is a graph showing six luminance levels for a gradation display which is produced for each driving mode.

FIG. 26 is a graph showing six intermediate display luminance levels provided by each of the driving modes a–d as mentioned above.

It should be noted that luminance levels other than these six intermediate luminance levels are virtually provided by the aforementioned multi-gradation processing circuit 33. Accordingly, as the difference between the respective six intermediate luminance levels is smaller, a more accurate intermediate luminance can be provided.

As such, in the present invention, the luminance distribution of an input video signal is measured every display line, and the number of light emissions allocated to the light emission sustain process Ic in each subfield is changed every display line in accordance with the measured luminance distribution.

More specifically, when the luminance distribution of a display line in an input video signal extends over the full luminance range (classification A) from "0" to "255," the driving mode a is performed for the display line. Specifically, in this event, gradation driving at six levels is performed for the full luminance range from "0" to "255."When the luminance distribution of one display line lies in the low luminance range from "0" to "50," the driving mode b is performed for the display line. Specifically, in this event, gradation driving at six levels is performed only for the low luminance range from "0" to "50." When the luminance distribution of a display line lies in the middle luminance range from "30" to "150," the driving mode c is performed for the display line. Specifically, in this event, gradation driving at six levels is performed only for the middle luminance range from "30" to "150." When the luminance distribution of a display line lies in the high luminance range from "50" to "255," the driving mode d is performed for the display line. Specifically, in this event, gradation driving at six levels is performed only for the high luminance range from "50" to "255."

It is therefore possible, according to the gradation driving as described above, to provide a good intermediate luminance in accordance with the contents of an input video signal.

In the foregoing embodiment, the luminance distribution measured every display line is classified into the classifications A–D as shown in FIG. 4, and the four driving modes a–d corresponding to the respective classifications are selectively performed in accordance with the measured luminance distribution. However, the manner of classifying the luminance distribution (how to define a luminance range) for one display line, the number of classifications, and implementations of the driving modes corresponding to the respective classifications (the number of light emissions allocated to the light emission sustain process in each subfield) are not limited to those described in the foregoing embodiment.

In the first data converter circuit 32, four conversion tables respectively corresponding to four previously set data conversion characteristics have been stored in four data converters 321, 323–325 such that a data conversion characteristic (conversion table) is alternatively selected in accordance with the luminance distribution classifying signal BC. Instead, however, the first data converter circuit 32 may be comprised of a single rewritable memory such that contents stored in the memory is updated with normalized data derived from an accumulated luminance distribution for one display line and the contents are used as the conversion table.

Figure 27:
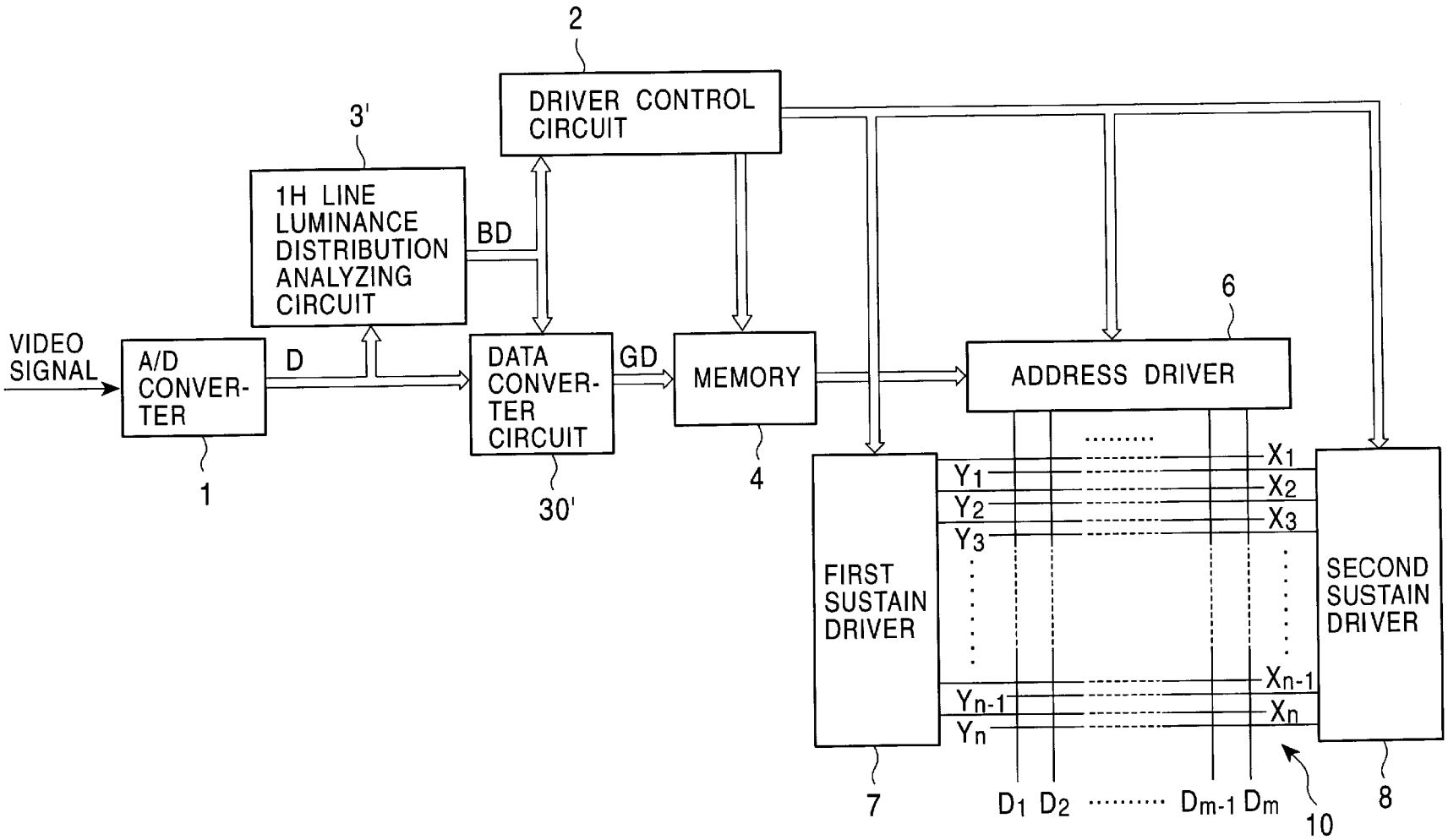
FIG. 27 is a block diagram illustrating another configuration of a plasma display device for driving a display panel in accordance with the driving method of the present invention.

FIG. 27 is a block diagram illustrating the configuration of a plasma display device which is made in view of the aspect mentioned above.

It should be noted that in FIG. 27, the configuration other than a 1H line luminance distribution analyzing circuit 3' and a data converter circuit 30 are identical to that illustrated in FIG. 1. Therefore, the following description will be made on the operation of the plasma display device illustrated in FIG. 27, centered on the 1H line luminance distribution analyzing circuit 3' and the data converter circuit 30'.

Figure 28:
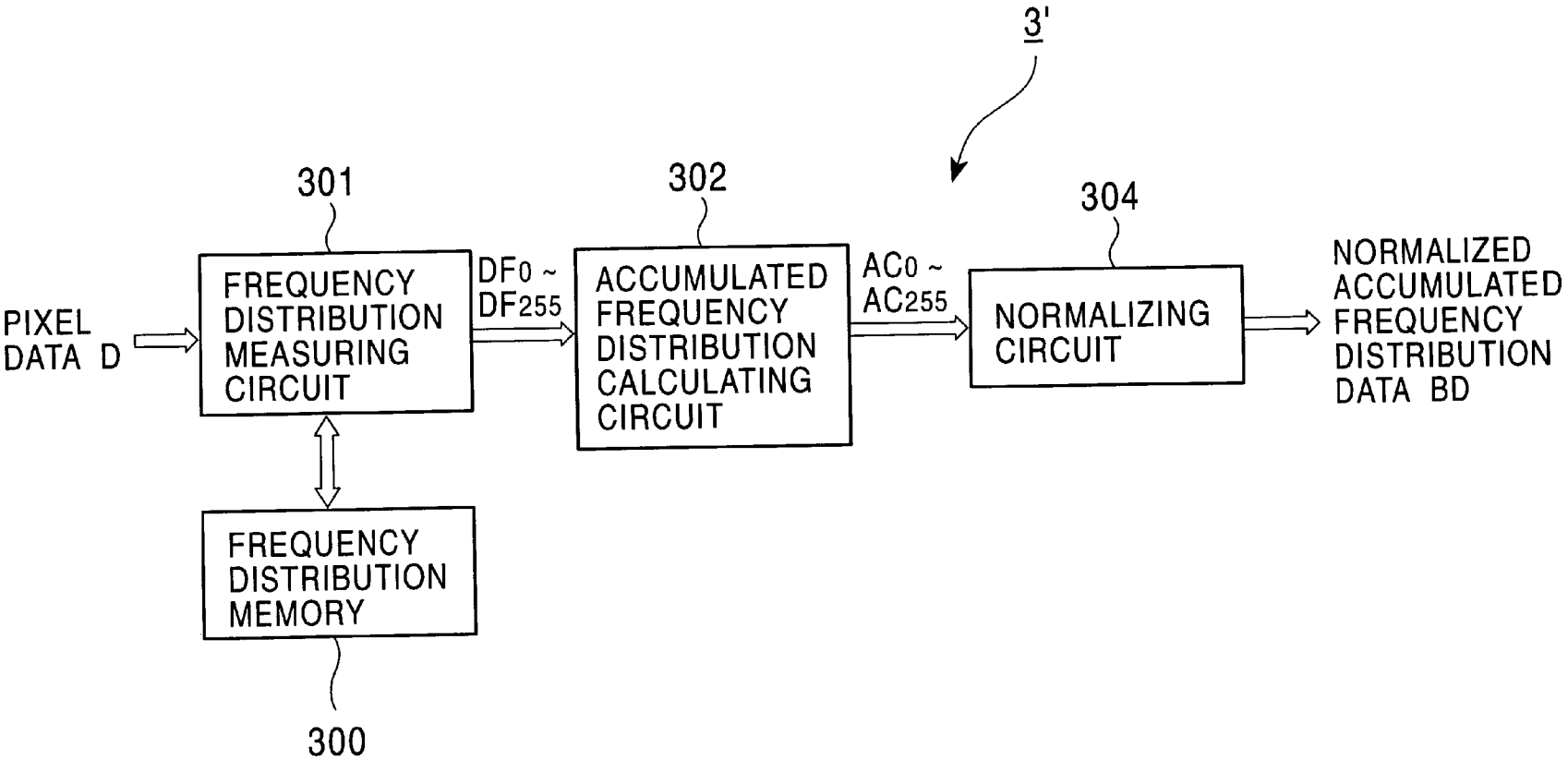
FIG. 28 is a block diagram illustrating the internal configuration of a 1H line luminance distribution analyzing circuit 3'.

FIG. 28 is a block diagram illustrating the internal configuration of the 1H line luminance distribution analyzing circuit 3'.

It should be noted that the operation of each of a luminance distribution memory 300, a frequency distribution measuring circuit 301, and an accumulated frequency distribution calculating circuit 302 illustrated in FIG. 28 are identical to that of the counterparts illustrated in FIG. 2. Specifically, the luminance distribution memory 300 and the frequency distribution measuring circuit 301, each time they are supplied with m pixel data D for one display line from the A/D converter 1, analyzes a luminance distribution in the display line based on the m pixel data D. Then, the frequency distribution measuring circuit 301 reads frequency data $DF_0$–$DF_{255}$ for luminance levels "0"–"255" in the display line from the frequency distribution memory 300, and supplies the frequency data $DF_0$–$DF_{255}$ to the accumulated frequency distribution calculating circuit 302. The accumulated frequency distribution calculating circuit 302 calculates accumulated frequency data $AC_0$–$AC_{255}$ for the luminance levels "0"–"255" respectively in the display line based on the frequency data $DF_0$–$DF_{255}$ and supplies the accumulated frequency data $AC_0$–$AC_{255}$ to a normalizing circuit 304.

The normalizing circuit 304 normalizes the accumulated frequency data $AC_0$–$AC_{255}$ and supplies each of the drive control circuit 2 and the data converter circuit 30' with normalized accumulated frequency distribution data DB for each of the luminance levels "0"–"255" in the display line.

Figure 29:
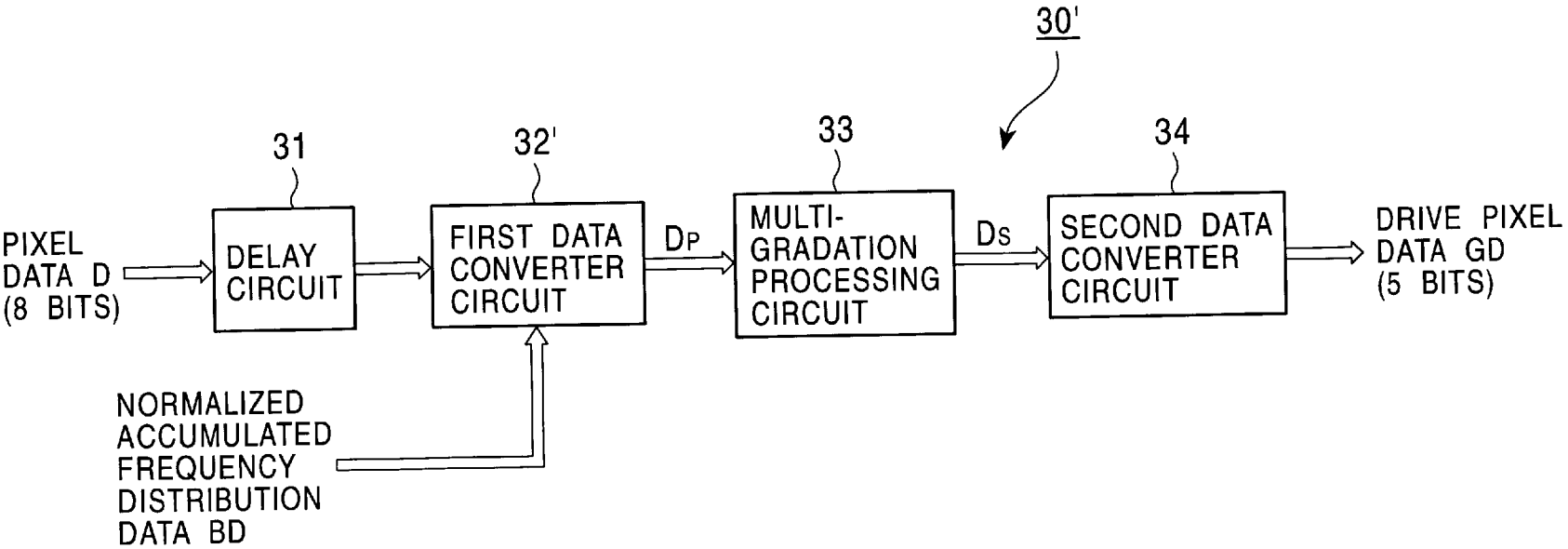
FIG. 29 is a block diagram illustrating the internal configuration of a data converter circuit 30'.

FIG. 29 is a block diagram illustrating the internal configuration of the data converter circuit 30'.

In FIG. 29, since the configuration other than a first data converter circuit 32' is identical to that illustrated in FIG. 17, the following description will be centered on the first data converter circuit 32'.

The first data converter circuit 32' is comprised of a rewritable memory, and stored contents (corresponding to a conversion table) in the memory is rewritten every display line by the normalized accumulated distribution data DB supplied from the 1H line luminance distribution analyzing circuit 3'.

For example, according to pixel data of one display line as shown in FIG. 5, a frequency distribution for the respective luminance levels "0"–"255" is as shown in FIG. 9, while its accumulated frequency distribution is as shown in FIG. 13. Thus, the conversion table in the first data converter circuit 32' is updated by the normalized accumulated frequency distribution data DB, resulting from the normalization of accumulated frequency data corresponding to FIG. 13, to rewrite the stored contents to a conversion characteristic as shown in FIG. 19.

Also, according to pixel data of one display line as shown in FIG. 6, a frequency distribution for the respective luminance levels "0"–"255" is as shown in FIG. 10, while its accumulated frequency distribution is as shown in FIG. 14. Thus, the conversion table in the first data converter circuit 32' is updated by the normalized accumulated frequency distribution data DB, resulting from the normalization of accumulated frequency data corresponding to FIG. 14, to rewrite the stored contents to a conversion characteristic as shown in FIG. 20.

Further, according to pixel data of one display line as shown in FIG. 7, a frequency distribution for the respective luminance levels "0"–"255" is as shown in FIG. 11, while its accumulated frequency distribution is as shown in FIG. 15. Thus, the conversion table in the first data converter circuit 32' is updated by the normalized accumulated frequency distribution data DB, resulting from the normalization of accumulated frequency data corresponding to FIG. 15, to rewrite the stored contents to a conversion characteristic as shown in FIG. 21.

Finally, according to pixel data of one display line as shown in FIG. 8, a frequency distribution for the respective luminance levels "0"–"255" is as shown in FIG. 12, while its accumulated frequency distribution is as shown in FIG. 16. Thus, the conversion table in the first data converter circuit 32' is updated by the normalized accumulated frequency distribution data DB, resulting from the normalization of accumulated frequency data corresponding to FIG. 16, to rewrite the stored contents to a conversion characteristic as shown in FIG. 22.

The drive control circuit 2 finds a luminance level frequency distribution corresponding to pixel data of one display line, i.e., a light emission driving format in accordance with an updated conversion characteristic of the first data converter circuit 32'. Specifically, the drive control circuit 2 finds a light emission driving format in accordance with the updated conversion characteristic in such a manner that the light emission driving format illustrated in the section (a) of FIG. 24 is selected for the conversion characteristic shown in FIG. 19; the format in the section (b) of FIG. 24 for the conversion characteristic in FIG. 20; the format in the section (c) of FIG. 24 for the conversion characteristic in FIG. 21; and the format in the section (d) of FIG. 24 for the conversion characteristic in FIG. 22. In this way, the drive control circuit 2 illustrated in FIG. 27 generates a light emission driving pattern optimal to each display line in real time in accordance with the luminance level frequency distribution of pixel data for one display line.

In the foregoing embodiment, the luminance distribution of an input video signal is measured every display line, and the driving mode (the number of light emissions allocated to the light emission sustain process in each subfield) for the display line is changed in accordance with the measured luminance distribution. Alternatively, however, the luminance distribution may be measured every display line group comprised of a plurality of display lines such that the driving mode is changed for each of the display lines belonging to the display line group in accordance with the measured luminance distribution.

Further alternatively, the driving mode may be changed every display line in accordance with the luminance distribution measured in units of display line groups as mentioned above.

For example, the luminance distribution is first measured for an input video signal corresponding to each of a first display line and a second display line on the PDP 10, and a driving mode for the first display line is determined in accordance with the measured luminance distributions. Next, the luminance distribution is measured for an input video signal corresponding to each of the second display line and a third display line, and a driving mode is determined for the second display line in accordance with the measured luminance distributions. In this way, the six-gradation level driving is performed as it is changed every display line only for a luminance range indicated by the luminance distribution of a video signal, measured every two display lines.

Also, in the foregoing embodiment, the selective erasure discharge is produced in the pixel data writing process Wc of any of the subfields SF1–SF5 as shown in FIG. 23. However, if a small amount of charged particles remain in a discharge cell, the selective erasure discharge may not be successfully produced, thereby failing to normally write pixel data. To solve this problem, a conversion table for the second data converter circuit 34 and light emission driving patterns shown in FIG. 30 are employed in place of those shown in FIG. 23. According to the light emission driving patterns shown in FIG. 30, the same selective erasure discharge is performed for each discharge cell a plurality of times in succession, so that the selective erasure discharges are produced without fail, and accordingly pixel data is correctly written.

The foregoing embodiment has been described for the so-called selective erasure address method, employed as a method of writing pixel data, wherein a wall charge is previously formed in each discharge cell, and the wall discharge is selectively erased in accordance with pixel data to write the pixel data.

The present invention, however, can be applied as well to a so-called selective write address method, employed as the method of writing pixel data, wherein wall charges are selectively formed in accordance with pixel data.

Figure 31:
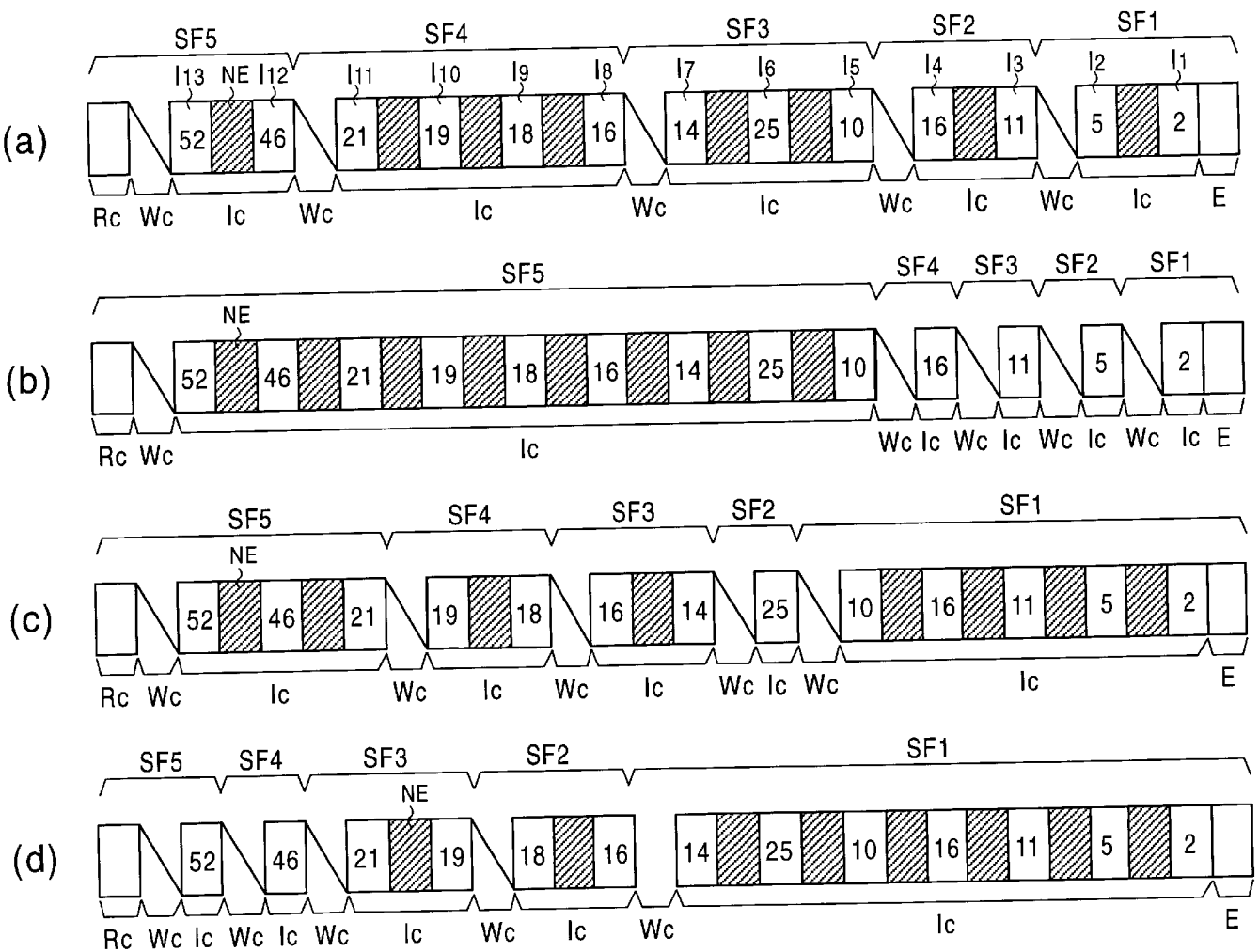
FIG. 31 is a diagram illustrating exemplary light emission driving formats which are used when a selective write address method is employed.

Sections (a)–(d) of FIG. 31 are diagrams illustrating light emission driving formats for use in driving the plasma display device illustrated in FIG. 1 employing the selective write address method. FIG. 32 is a diagram showing a conversion table used in the second data converter circuit 34, and light emission driving patterns when the selective write address method is employed.

When the selective write address method is employed, the order of the subfields SF is reversed to that when the selective erasure address method is employed, as illustrated in the sections (a)–(d) of FIG. 31. Specifically, the subfield SF5 is used as the first subfield, while the subfield SF1 is used as the last subfield. The formats illustrated in the sections (a)–(d) of FIG. 31 are similar to the formats illustrated in the sections (a)–(d) of FIG. 24, which are used when the selective erasure address method is employed, in that the pixel data writing process Wc and the light emission sustain process Ic are performed in each subfield but the simultaneous reset process Rc is performed only in the first subfield.

Here, the drive control circuit 2 selects one from the light emission driving formats illustrated in the sections (a)–(d) of FIG. 31 in accordance with a classification of a luminance distribution indicated by the luminance distribution classifying signal BC. Then, the drive control circuit 2 supplies each of the address driver 6, first sustain driver 7 and second sustain driver 8 with a variety of timing signals for driving the PDP 10 in accordance with the selected light emission driving format.

Figure 33:
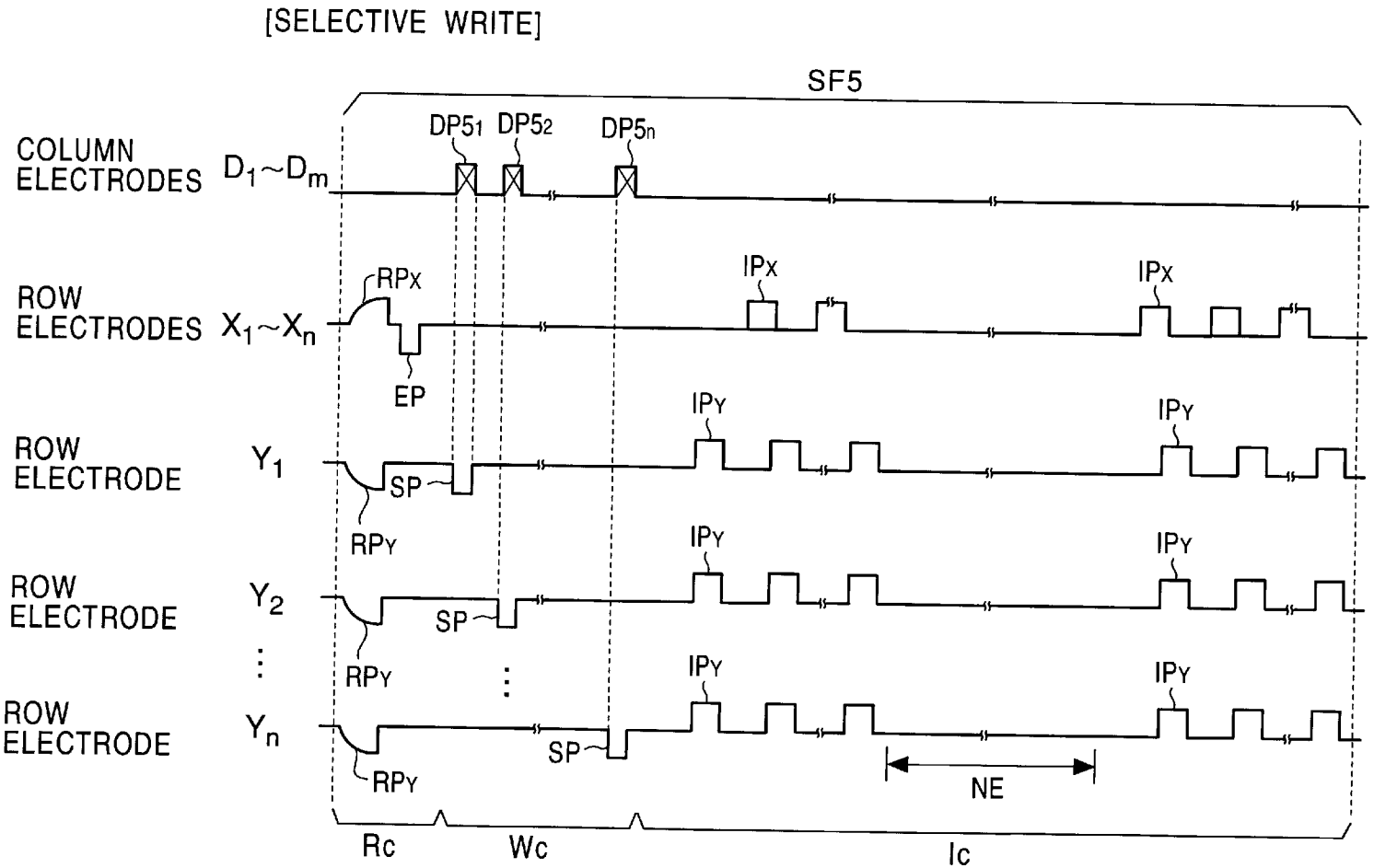
FIG. 33 is a waveform chart showing application timings at which a variety of driving pulses are applied when the PDP 10 is driven to display in gradation representation in accordance with the light emission driving formats illustrated in FIG. 31.

FIG. 33 is a waveform chart showing application timings at which each of the first sustain driver 7 and the second sustain driver 8 applies the PDP 10 with a variety of driving pulses when the selective write address method as mentioned above is employed. It should be noted that FIG. 33 only shows application timings only in the first subfield SF5 extracted from the light emission driving format.

In FIG. 23, in the simultaneous reset process Rc, immediately after the first sustain driver 7 and the second sustain driver 8 generate the reset pulse $RP_X$ and pulse $RP_Y$ to the row electrodes X and Y, respectively, the first sustain driver 7 simultaneously applies an erasure pulse EP to the row electrodes $X_1$–$X_n$ of the PDP 10. The application of the erasure pulse causes an erasure discharge to be produced and extinguish wall charges formed in all the discharge cells. In other words, in the simultaneous reset process Rc when the selective write address method is employed as shown in FIG. 33, all the discharge cells in the PDP 10 are initialized to "non-light emitting cells."

In the pixel data writing process Wc, as is the case when the selective erasure address method is employed, the address driver 6 generates a pixel data pulse group DP of one row having voltages corresponding to logical levels of drive pixel data bits DB, and sequentially applies the pixel data pulses for each row to the column electrodes $D_1$–$D_m$. Further, in the pixel data writing process Wc, the second sustain driver 8 generates a scanning pulse SP of negative polarity at the same timing at which each pixel data pulse group DP is applied, and sequentially applies the scanning pulse SP to the row electrodes $Y_1$–$Y_n$. In this condition, the discharge (selective writing discharge) occurs only in discharge cells at intersections of "rows" applied with the scanning pulse SP with "columns" applied with the pixel data pulse at the high voltage to form wall charges in the discharge cells. Specifically, the selective write discharge is produced only in the pixel data writing process Wc in those subfields which correspond to bit digits at logical level "1" in the drive pixel data GD as shown in FIG. 32. The selective write discharge causes the discharge cells initialized to the "non-light emitting cell" state in the simultaneous reset process Rc to transition to a "light emitting cell" state. On the other hand, the discharge is not produced in discharge cells formed in "columns" which have not been applied with the pixel data pulse at the high voltage, so that these discharge cells are maintained in the initialized state in the simultaneous reset process Rc, i.e., the "non-light emitting cell" state.

Next, in the light emission sustain process Ic, the first sustain driver 7 and the second sustain driver 8 alternately apply the sustain pulses $IP_X$, $IP_Y$ of positive polarity to the row electrodes $X_1$–$X_n$ and $Y_1$–$Y_n$, as illustrated in FIG. 33. The application of the sustain pulses IP causes the discharge cells in which the wall charges have been formed in the pixel data writing process Wc, i.e., in the "light emitting cells" to discharge for sustaining the light emission each time they are applied with the sustain pulses $IP_X$, $IP_Y$. In this event, according to the drive pixel data bits DB shown in FIG. 32, the light emission is sustained the number of times (period) described in the sections (a)–(d) of FIG. 31 in the light emission sustain process Ic in each of subfields in which the selective write discharges have been produced (indicated by black circles) and subfields subsequent thereto (indicated by white circles).

Therefore, when the selective write address method is employed, the six-level gradation driving is performed every display line (or every plural display lines) only for a luminance range on the display line (or the plurality of display lines), as is the case when the selective erasure address method is employed.

While the foregoing embodiment performs the six-level gradation driving, the number of gradation levels is not limited to six, but may be any number of gradation level equal to or larger than two. In essence, the luminance distribution of an input video signal may be measured every display line or every plural display lines such that N-level gradation driving (N is a natural number) intended for a luminance range indicated by the luminance distribution is performed every display line or every plural display lines.

As described above in detail, in the present invention, the luminance distribution of an input video signal is measured every display-line, and the number of light emissions allocated to the light emission sustain process in each subfield is changed every display line in accordance with the luminance distribution. Since this permits N-level gradation driving to be performed every display line only for a luminance range on the display line, a good intermediate luminance can be provided in accordance with the contents of the input video signal.

What is claimed is:

1. A display panel driving method for driving a display panel having a plurality of pixel cells arranged in matrix in accordance with a video signal, said method comprising:

performing, in each of a plurality of divisional display periods of a unit display period in said video signal, a pixel data writing process for setting each of said pixel cells to either a light emitting cell or a non-light emitting cell in accordance with pixel data corresponding to said video signal to write the pixel data, and a light emission sustain process for causing only said light emitting cells to emit light a number of light emissions allocated thereto corresponding to a weighting factor applied to each of said divisional display periods;

obtaining a luminance distribution of said video signal every display line on said display panel; and changing said number of light emissions allocated to said divisional display period every display line in accordance with said luminance distribution.

2. A display panel driving method according to claim 1, wherein said luminance distribution is calculated based on an accumulated frequency of each luminance level in the video signal of one display line.

3. A display panel driving method according to claim 1, further comprising:

performing a reset process for initializing all said pixel cells to one of said light emitting cell and non-light emitting cell states only in said divisional display period at the beginning of said unit display period; and setting said pixel cells into one of said non-light emitting cell and light emitting cell states only in said pixel data writing process in one of said divisional display periods.

4. A display panel driving method according to claim 1, further comprising:

performing a reset process for initializing all said pixel cells to one of said light emitting cell and non-light emitting cell states only in said divisional display period at the beginning of said unit display period; and setting said pixel cells into one of said non-light emitting cell and light emitting cell states only in said pixel data writing process in one of said divisional display periods, and again setting said pixel cells into said one state in said pixel data writing process in at least one divisional display period which exists after said one divisional display period.

5. A display panel driving method as claimed in claim 1, wherein N-level gradation driving is performed every display line only in a luminance range indicated by said luminance distribution.

6. A display panel driving method for driving a display panel having a plurality of pixel cells arranged in matrix in accordance with a video signal, said method comprising:

performing, in each of a plurality of divisional display periods of a unit display period in said video signal, a pixel data writing process for setting each of said pixel cells to either a light emitting cell or a non-light emitting cell in accordance with pixel data corresponding to said video signal to write the pixel data, and a light emission sustain process for causing only said light emission cells to emit light a number of light emissions allocated thereto corresponding to a weighting factor applied to each of said divisional display periods;

obtaining a luminance distribution of said video signal every plural display lines on said display panel; and changing said number of light emissions allocated to said divisional display period every plural display lines in accordance with said luminance distribution.

7. A display panel driving method according to claim 6, wherein said luminance distribution is calculated based on an accumulated frequency of each luminance level in the video signal of a plurality of display lines.

8. A display panel driving method according to claim 6, further comprising:

performing a reset process for initializing all said pixel cells to one of said light emitting cell and non-light emitting cell process only in said divisional display period at the beginning of said unit display period; and setting said pixel cells into one of said non-light emitting cell and light emitting cell states only in said pixel data writing process in one of said divisional display periods.

9. A display panel driving method according to claim 6, further comprising:

performing a reset process for initializing all said pixel cells to one of said light emitting cell and non-light emitting cell states only in said divisional display period at the beginning of said unit display period; and setting said pixel cells into one of said non-light emitting cell and light emitting cell states only in said pixel data writing process in one of said divisional display periods, and again setting said pixel cells into said one state in said pixel data writing process in at least one divisional display period which exists after said one divisional display period.

10. A display panel driving method as claimed in claim 5, wherein N-level gradation driving is performed every plural display lines only in a luminance range indicated by said luminance distribution.

11. A display panel driving method for driving a display panel having a plurality of pixel cells arranged in matrix in accordance with a video signal, said method comprising:

performing, in each of a plurality of divisional display periods of a unit display period in said video signal, a pixel data writing process for setting each of said pixel cells to either a light emitting cell or a non-light emitting cell in accordance with pixel data corresponding to said video signal to write the pixel data, and a light emission sustain process for causing only said light emission cells to emit light a number of light emissions allocated thereto corresponding to a weighting factor applied to each of said divisional display periods;

obtaining a luminance distribution of said video signal every plural display lines on said display panel; and changing said number of light emissions allocated to said divisional display period every display line in accordance with the luminance distribution.

12. A display panel driving method according to claim 11, wherein said luminance distribution is calculated based on an accumulated frequency of each luminance level in the video signal of a plurality of display lines.

13. A display panel driving method according to claim 11, further comprising:

performing a reset process for initializing all said pixel cells to one of said light emitting cell and non-light emitting cell process only in said divisional display period at the beginning of said unit display period; and setting said pixel cells into one of said-non-light emitting cell and light emitting cell states only in said pixel data writing process in one of said divisional display periods.

14. A display panel driving method according to claim 11, further comprising:

performing a reset process for initializing all said pixel cells to one of said light emitting cell and non-light emitting cell states only in said divisional display period at the beginning of said unit display period; and setting said pixel cells into one of said non-light emitting cell and light emitting cell states only in said pixel data writing process in one of said divisional display periods, and again setting said pixel cells into said one state in said pixel data writing process in at least one divisional display period which exists after said one divisional display period.

15. A display panel driving method as claimed in claim 11, wherein N-level gradation driving is performed every display line only in a luminance range indicated by said luminance distribution.

* * * * *